US006350025B1

(12) United States Patent
Morita et al.

(10) Patent No.: US 6,350,025 B1
(45) Date of Patent: Feb. 26, 2002

(54) INK TANK WITH IMPROVED HANDLING, TANK HOLDER FOR INSTALLATION OF SUCH INK TANK, INK JET CARTRIDGE, AND INK JET RECORDING APPARATUS

(75) Inventors: Osamu Morita, Yokosuka; Hiroshi Koshikawa; Kenji Kitabatake, both of Kawasaki, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/389,365

(22) Filed: Sep. 3, 1999

(30) Foreign Application Priority Data

Sep. 3, 1998 (JP) ..... 10-249669
Oct. 27, 1998 (JP) ..... 10-306175
Sep. 1, 1999 (JP) ..... 11-247472

(51) Int. Cl.[7] ..... B41J 2/175
(52) U.S. Cl. ..... 347/86
(58) Field of Search ..... 347/85, 86, 87, 347/108, 152

(56) References Cited

U.S. PATENT DOCUMENTS 5,815,183 A * 9/1998 Sasaki ..... 347/86
6,024,442 A 2/2000 Sato et al. ..... 347/85

FOREIGN PATENT DOCUMENTS

EP 0822084 A2 * 4/1998 ..... B41J/2/175

* cited by examiner

*Primary Examiner*—Anh T. N. Vo
(74) *Attorney, Agent, or Firm*—Fitzpatrick, Cella, Harper & Scinto

(57) ABSTRACT

An ink tank is detachably held by a tank holder having an arc shape portion of a specific curvature. This ink tank has also an arc shape portion of a specific curvature, and the arc center of the arc shape portion of the ink tank is in the same position as the arc center of the arc shape portion of the tank holder only when the ink tank is correctly installed on the tank holder. The ink tank is provided with the movable lever having the engagement nail to engage with the tank holder, and the movable lever is provided with the tongue portion on the upper portion of the engagement nail to be operated when the ink tank is removed from the tank holder, and the arc shape portion of the ink tank is the portion of the arc shape formed for the tongue portion. With the structure thus arranged, it becomes possible to facilitate the user to install the ink tank on the tank holder correctly and reliably without exercising any extra force leading to the damage that may be caused to the ink tank.

27 Claims, 28 Drawing Sheets

INK TANK WITH IMPROVED HANDLING, TANK HOLDER FOR INSTALLATION OF SUCH INK TANK, INK JET CARTRIDGE, AND INK JET RECORDING APPARATUS

BACKGROUND OF THE INVENTION

1. Field of the Invention

The present invention relates to an ink tank, a tank holder to detachably hold the ink tank, an ink jet head cartridge provided with an ink jet head mounted on the tank holder to discharge ink for recording, and an ink jet recording apparatus provided with the ink jet head cartridge.

2. Related Background Art

FIG. 25 is a perspective view which shows the general ink jet recording apparatus conventionally in use. For the ink jet recording apparatus shown in FIG. 25, the lead screw 104 and the guide shaft 105, which are arranged to be in parallel to each other, are provided for a housing. For the lead screw 104 and the guide shaft 105, a carriage 101 is installed to be able to travel in the direction parallel to the lead screw 104 and the guide shaft 105. The carriage 101 is driven to travel in parallel to the lead screw 104 which is rotated by a carriage motor (not shown).

As described later in conjunction with FIGS. 26A and 26B, the ink jet head cartridge provided with the ink jet head 102 is mounted on the carriage 101. In the vicinity of the traveling orbital plane of the discharge surface of the ink jet head 102, a sheet pressure plate 109 is arranged.

Also, the ink jet recording apparatus is provided with a sheet feed roller 107 that carries a recording sheet 106 which serves as a recording medium to the recording area of the ink jet head 102, and also, with a sheet exhaust roller 108 which is arranged to exhaust the recording sheet 106 having a recorded object on it by the ink jet head 102. The sheet feed roller 107 and the sheet exhaust roller 108 are driven to rotate by use of a motor (not shown).

When the ink which is discharged from the ink jet head 102 adheres to the recording sheet 106 facing the discharge port surface of the ink jet head 102, the recorded images are formed on the surface of the recording sheet 106. Interlocked with recording to the recording sheet 106 by the ink jet head 102, the sheet feed roller 107 and the sheet exhaust roller 108 are rotated by the motor to exhaust the recording sheet 106 outside the ink jet recording apparatus in cooperation with the sheet pressure roller 109.

FIGS. 26A and 26B are views which illustrate the ink jet head cartridge to be mounted on the carriage 101 shown in FIG. 25. FIG. 26A is a perspective view which shows the ink jet head cartridge to be mounted on the carriage 101. FIG. 26B is a perspective view which shows the state where ink tanks are removed from the ink jet head cartridge shown in FIG. 26A.

As shown in FIG. 26A and FIG. 26B, the ink jet head cartridge 301 which is mounted on the carriage 101 comprises a tank holder 103 provided with the ink jet head 102; and ink tanks 111, 112, 113, and 114, which are detachably mountable on the tank holder 103. The ink tank 111 is for use of black ink; the ink tank 112 is for use of yellow ink; the ink tank 113 is for use of magenta ink; and the ink tank 114 is for use of cyan ink. Each of the ink tanks 111, 112, 113, and 114 is detachably mountable on the tank holder 103. Each of the ink tanks is exchangeable, which contributes to lowering the running costs of printing by the ink jet recording apparatus.

For each of the ink tanks 111, 112, 113, and 114, ink of the corresponding color is contained in it, respectively. Also, for each of them, the ink supply port is formed to supply the ink contained in it to the ink jet head 102. For example, the ink supply port 211 is formed for the ink tank 111. Then, black ink contained in the ink tank 111 is supplied to the ink jet head 102 through the ink supply port 211 in the state where the ink tank 111 is installed on the tank holder 103.

FIG. 27 is a cross-sectional view which shows the tank holder 103 and the ink jet head 102 represented in FIGS. 26A and 26B. As shown in FIG. 27, the upper surface of the box-type tank holder 103 is open, and the ink jet head 102 is arranged for one side portion on the bottom face of the tank holder 103. In the ink jet head 102, the silicon substrate 201 is supported by the base plate 205. On the silicon substrate 201, heaters or the like are formed as electrothermal converting means to generate thermal energy utilized for ink discharges.

Also, for the ink jet head 102, a joint 204 is provided to be connected with the ink supply port of the ink tank when the ink tank is installed on the hand holder 103. For the joint 204, an ink flow path 206 is formed to extend to the silicon substrate 201.

Now, exemplifying the ink tank 111 for use of black ink, the description will be made of the ink flow in an ink jet head cartridge of the kind. Ink in the ink tank 111 is supplied to the interior of the ink jet head 2 through the ink supply port 211 of the ink tank 111 and the joint 204. The ink which is supplied to the interior of the ink jet head 2 is supplied to the silicon substrate 201 through the ink flow path 206. Then, the ink thus supplied is discharged to a recording sheet which serves as the recording medium by the application of thermal energy generated by the heater on the silicon substrate 201.

FIGS. 28A to 28C are views which illustrate the ink tank 111 represented in FIGS. 26A and 26B. FIG. 28A is a perspective view which the ink tank 111, observed in the direction in which a second nail 132 is visible. FIG. 28B is a perspective view which shows the ink tank 111, observed in the direction in which a movable lever 130 is visible. FIG. 28C is a cross-sectional view which shows the ink tank 111.

As shown in FIGS. 28A and 28B, the ink tank 111 has the movable lever 130 having a first nail 131 for it on one side of thereof. On the other side of the ink tank 111, the second nail 132 is arranged. When the ink tank 111 is installed on the tank holder 103, the first nail 131 and the second nail 132 engage with a first hole 241 and a second hole 242 (see FIG. 27) formed on the tank holder 103, respectively. In this manner, the ink tank 111 is fixed to the tank holder 103. On the bottom face of the ink tank 111, the ink supply port 211 is arranged to be cylindrically extruded from the bottom face thereof.

Also, as shown in FIG. 28C, in the interior of the ink tank 111, an ink absorbent 136 is housed to retain ink by absorbing the liquid ink. In the interior of the ink supply port 221, the Joint member 137 is filled to be connected with the ink absorbent 136. When the ink tank 111 is installed on the tank holder 103, ink retained in the ink absorbent 136 is supplied to the ink jet head 102 from the ink supply port 211 through the joint member 137.

Now, in conjunction with FIGS. 29A to 29C, the description will be made of the procedures for the installation of the ink tank 111 onto the tank holder 103 of the ink jet head cartridge 301.

At first, as shown in FIG. 29A, the surface of the ink tank 111 on the ink supply port 211 side is placed to face the upper surface of the tank holder 103. And, the ink tank 111 is inserted into the interior of the tank holder 103 in the direction indicated by an arrow A, while the second nail 132 of the ink tank 111 is inclined downward.

Then, as shown in FIG. 29B, the second nail 132 of the ink tank 111 engages with the second hole 242 of the tank holder 103 at first when the ink tank is inserted along the side inclination of the holder 103 on the right side in FIG. 29B.

Further, as shown in FIG. 29C, when the ink tank 111 is pressed into the tank holder 103, the movable lever 130 is bent inward so as to enable the first nail 131 to engage with the first hole 241 of the tank holder 103. Thus, the ink tank 111 is fixed to the tank holder 103.

In this state, ink retained in the ink absorbent 136 is introduced to the ink jet head 202 through the joint member 137 of the ink supply port 211, and discharged from the discharge port (not shown) by the application of energy generated by the electrothermal converting means (not shown).

Here, in order to remove the ink tank 111, the movable lever 130 is bent inward to enable the first nail 131 to be drawn for the first hole 241 of the tank holder 103. Then, it becomes easy to remove the ink tank 111 from the tank holder 103.

In accordance with the conventional art described above, however, it is impossible for the user or the like who uses an ink jet recording apparatus for the first time to recognize the correct condition of the ink tank installation exactly when the ink tank is installed on the tank holder. As a result, in some cases, the installation is not completed as in the final condition which is represented in FIG. 29C.

Particularly, since the molding material becomes hardened under a low temperature environment, there is a need for exercising a large force to push in the ink tank onto the tank holder. As a result, there is a tendency that the ink tank is not pressed until it is installed perfectly. Then, if any recording is executed in the state where the ink tank is not installed on the tank holder perfectly, ink in the ink tank is not supplied to the ink jet head sufficiently to as to present a drawback that recording is not made exactly in some cases.

Also, it is possible to confirm the installation of the ink tank by means of a clicking sound (or by sensing it), but depending on the use environments, it becomes difficult to make such confirmation, and there is still a fear that the completion of the ink tank installation is not necessarily confirmed in such a manner in some cases.

Also, if the ink tank should be made smaller to meet the requirement of making the apparatus smaller, it is inevitable that the tongue portion of the movable lever of the ink tank should be made smaller accordingly. In this case, then, the user finds it difficult to remove the ink tank. Further, in a case where a plurality of ink tanks having ink of different colors should be arranged adjacent to each other in a tank holder, there is encountered a problem that it becomes inconvenient to handle ink tanks if the tongue portion of each movable lever of the ink tanks is made smaller as described above, because the user wrongly picks up the one next to the ink tank that he intends to remove at that time.

SUMMARY OF THE INVENTION

In consideration of the technical problems described above, the present invention is designed. It is an object of the invention to provide an ink tank with the excellent handling ease with which the use can recognize the correct installation of ink tank on the tank holder, an ink jet head cartridge, and an ink jet recording apparatus provided with the ink jet head cartridge.

Also, with the conventional structure described above, the breakage of the fulcrum portion of the foot section of the movable lever may take place if the user should unexpectedly drop the ink tank with the side where the movable lever is arranged downward or in some other accidental cases. As a result, the drawback that the ink tank cannot be installed on the tank holder may be encountered. Particularly, under the lower temperature environment, the mold material becomes hardened to be brittle, and there is a tendency that it becomes easier for the movable member to be broken in such accidental cases as described above.

Therefore, it is another object of the present invention to provide an ink tank with improved handling, which withstands the shock received when the ink tank is dropped or the unexpected shocks given from the outside, and also, to provide an ink jet head cartridge, as well as an ink jet recording apparatus provided with such ink jet head cartridge.

In order to achieve the objects described above, the ink tank of the present invention is detachably held by a tank holder having an arc shape portion of a specific curvature. This ink tank has also an arc shape portion of a specific curvature, and the arc center of the arc shape portion of the ink tank is in the same position as the arc center of the arc shape portion of the tank holder only when the ink tank is correctly installed on the tank holder.

This ink tank has the movable lever provided with the engagement nail to engage with the tank holder, and the movable lever is provided with the tongue portion on the upper portion of the engagement nail to be operated when the ink tank is removed from the tank holder, and the arc shape portion of the ink tank is the portion of the arc shape formed for the tongue portion.

The movable lever referred to in the preceding paragraph is resiliently connected with the ink tank, and a part of the connected portion is formed thinner in the thickness thereof.

Here, it is preferable that the arc shape portion of the ink tank is different in accordance with the ink capacity of the ink tank, and that the arc shape portion of the ink tank is different in accordance with the kind of ink in the ink tank.

The aforesaid movable lever is molded integrated with the ink tank.

The curvature radius of the ink tank and that of the tank holder are the same dimension.

Further, the ink head cartridge of the invention comprises a tank holder according to either one of those referred to in the preceding paragraphs, and an ink jet recording head for discharging ink to be supplied from the ink tank installed on the tank holder.

Further, the ink jet recording apparatus of the invention comprises a carriage which detachably holds an ink jet head cartridge described above, and which is supported to be able to reciprocate along the surface of a recording medium. Then, ink is discharged from the ink jet recording head portion of the ink jet head cartridge for recording on the recording medium in accordance with electric signals for ink discharges.

With the structure arranged as above, unless the ink tank is installed on the tank holder correctly, the arc center of the arc shape portion of the ink tank and that of the tank holder are not in the same position. Therefore, the connection between the arc shape portions of the ink tank and tank holder become unnatural at the time of installation. Thus, the user can recognize the incorrect installation of the ink tank by eye-sight so as to enable him to operate the installation again.

Also, in order to achieve the objectives discussed above, the ink tank of the present invention is detachably held by a tank holder which is provided with a movable lever having the engagement nail to engage with the tank holder, and resiliently supported on the foot section of the movable member. For this ink tank, a part of the foot section of the movable lever is formed thinner in the thickness thereof.

For the ink tank of the invention structured as described above, a part of the foot section of the movable lever is formed thinner in the thickness thereof. As a result, even if a shock destructive force is given to the movable lever to cause crack on the wall thickness portion, the development of such crack is blocked by the thinner thickness portion, hence preventing the movable lever from being broken.

The movable lever may be molded integrally, and the central portion of the movable lever may be made thinner in the thickness thereof. The thickness of the portion formed thinner may be less than a half the thickness of other portions of the food section of the movable lever.

Also, the movable lever is provided with the tongue portion that serves as the operational part when the ink tank is attached to or detached from the tank holder. It is preferable to provide an arc portion for this tongue portion. Particularly, in the state where the ink tank is installed, it is preferable to arrange the location where the tongue portion of the ink tank is positioned to be in the form of arc which is coaxial with the arc center of the tongue portion. This is desirable from the viewpoint of enhancing the reliability of installation.

Also, the ink jet head cartridge of the invention comprises a tank holder capable of detachably holding an ink tank referred to either one of the preceding paragraphs, and a liquid discharge head unit for discharging ink to be supplied from the ink tank.

Also, the in ink jet recording apparatus of the invention comprises a carriage which detachably holds an ink jet head cartridge referred to in the preceding paragraph, and according to claim 21, and which is supported to be able to reciprocate along the surface of a recording medium. Then, ink is discharged from the liquid discharge recording head unit of the ink jet head cartridge for recording on the recording medium in accordance with electric signals for ink discharges.

Further, the ink tank of the invention is detachably held on a tank holder having the arc shape portion of a specific curvature. For this ink tank, the movable lever is provided with the engagement nail to engage with the tank holder, and resiliently supported by the ink tank at the foot section thereof; the movable lever is provided with a tongue portion on the upper part of the engagement nail to be operated when attaching the ink tank to or detaching it from the tank holder; the tongue portion is provided with the arc shape portion of a specific curvature; and the arc center of the arc shape portion of the ink tank is in the same position of the arc center of the arc shape portion of the tank holder only in the position of the ink tank correctly installed on the tank holder, and at the same time, a part of the foot section of the movable lever is formed thinner in the thickness thereof.

It is preferable to make the arc portion of the ink tank different in accordance with the ink capacity of the ink tank.

Also, it is preferable to make the arc portion of the ink tank different in accordance with the kind of ink in the ink tank.

Also, it is preferable to make the thickness of the thinner portion less than a half the thickness of other portions of the foot section of the movable lever.

Other objectives and advantages besides those discuss above will be apparent to those skilled in the art from the description of a preferred embodiment of the invention which follows. In the description, reference is made to accompanying drawings, which form a part hereof, and which illustrate an example of the invention. Such example, however, is not exhaustive of the various embodiments of the invention, and therefore reference is made to the claims which follow the description for determining the scope of the invention.

BRIEF DESCRIPTION THE DRAWINGS

Figure 20:
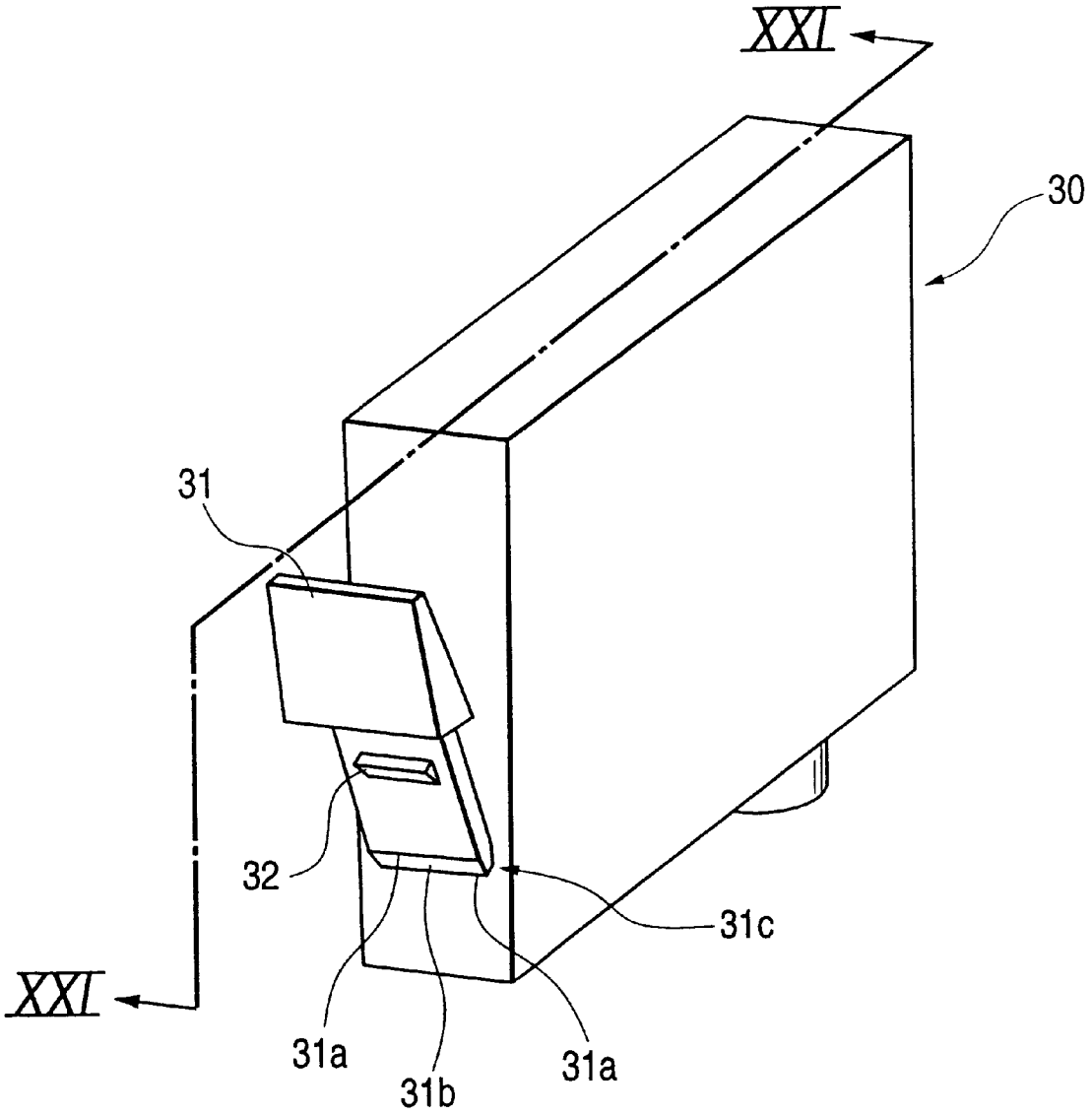

FIG. 20 s a perspective view which shows another ink tank to which the present invention is applicable.

Figure 21A:
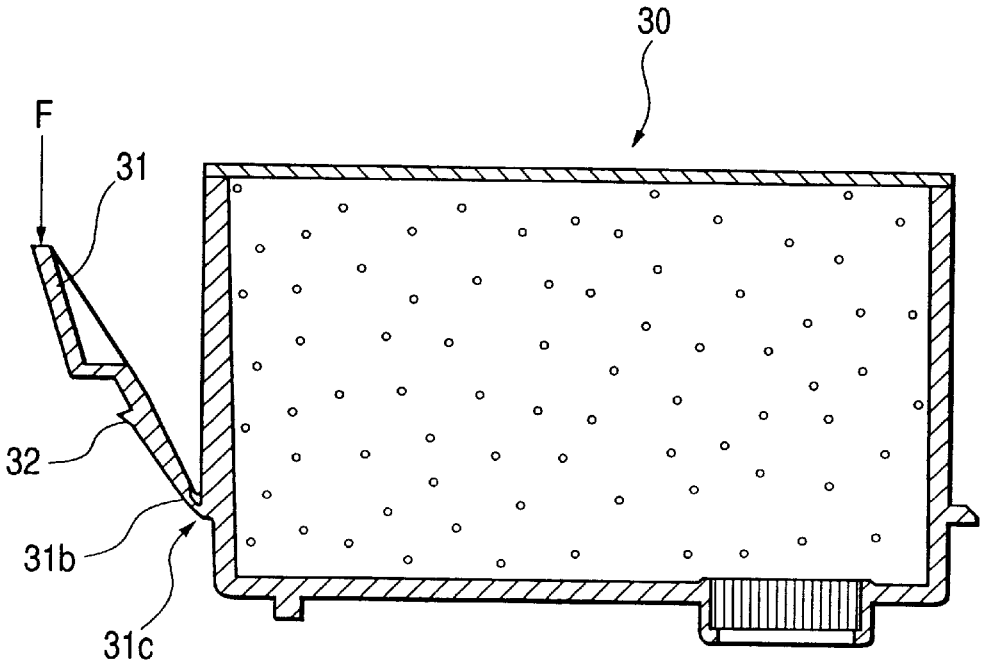
Figure 21B:
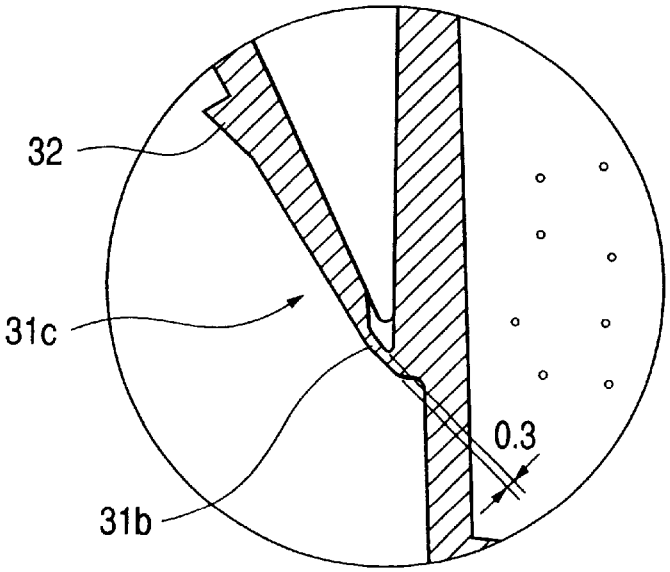

FIG. 21A is a cross-sectional view which shows the ink tank represented in FIG. 20, taken along line XXI—XXI, and FIG. 21B is an enlargement of the detailed view which illustrates the foot section of the movable lever thereof.

Figure 22:
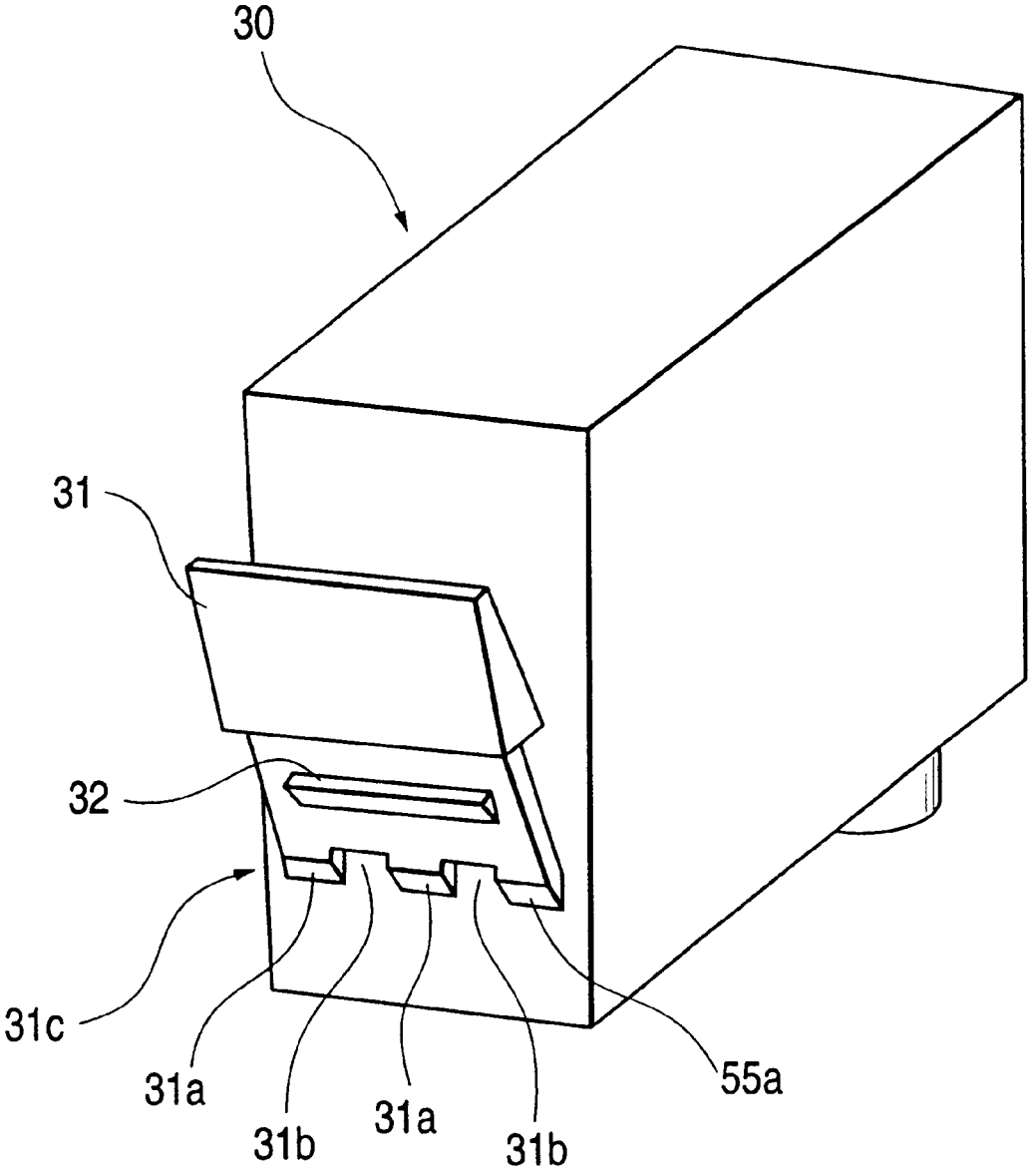

FIG. 22 is a perspective view which shows still another example of the ink tank to which the present invention is applicable.

Figure 23A:
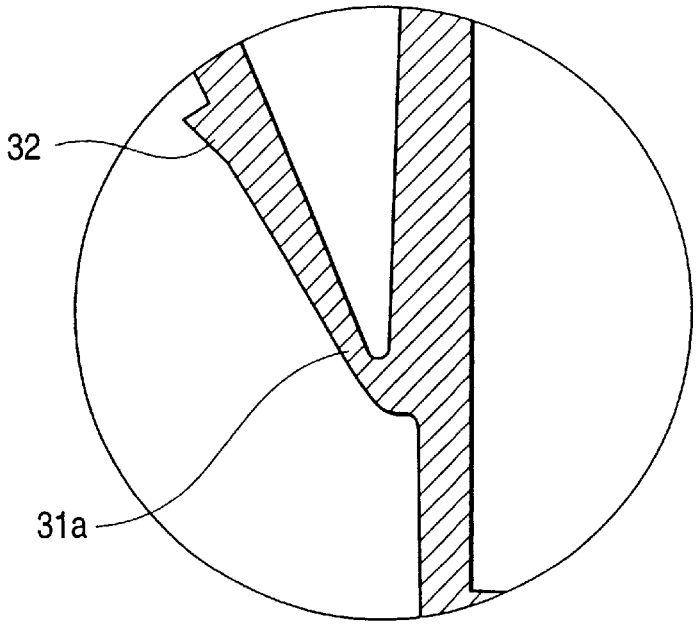
Figure 23B:
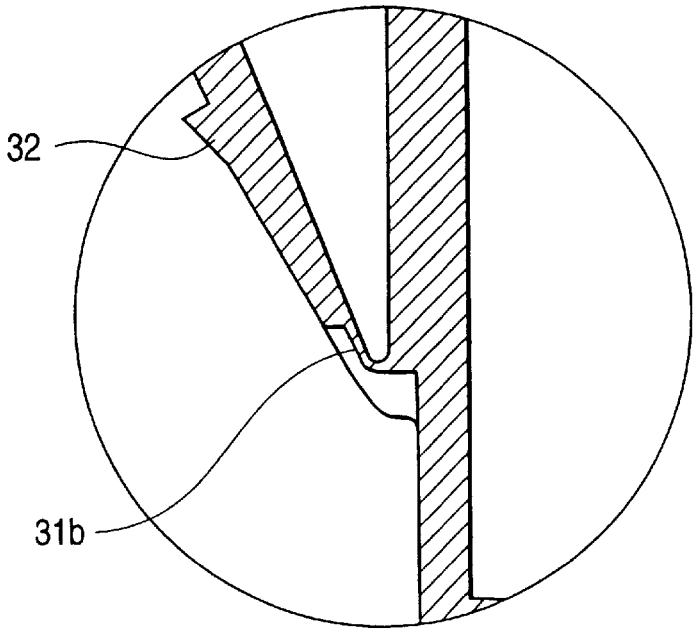

FIGS. 23A and 23B are enlargements of detailed views of the wall thickness of the foot section of the movable member of the ink tank shown in FIG. 22, and the thinner thickness portion thereof, respectively.

Figure 24B:
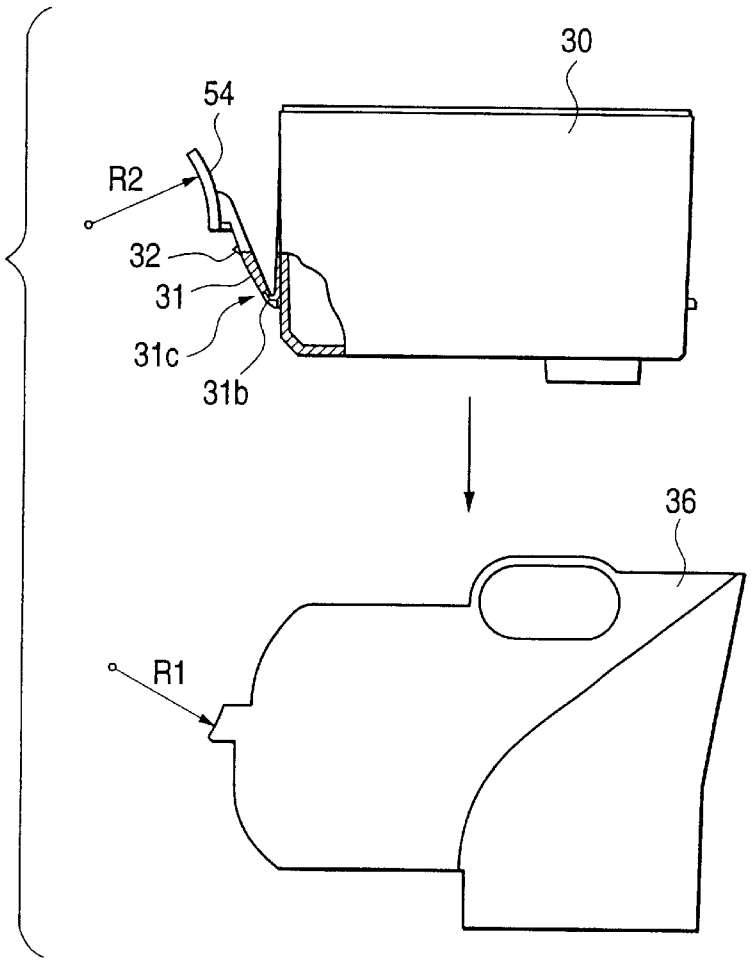
Figure 24A:
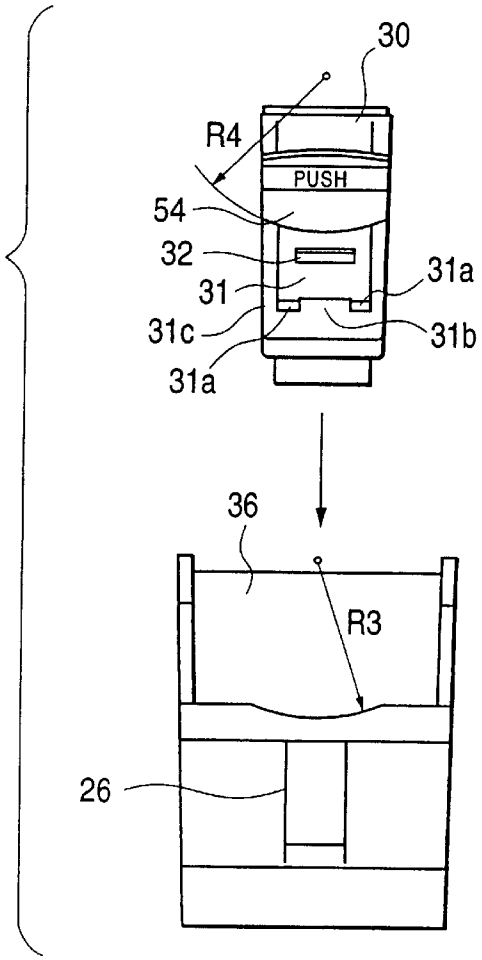

FIGS. 24A and 24B are views which illustrate still another ink tank and tank holder to which the present invention is applicable.

Figure 25:
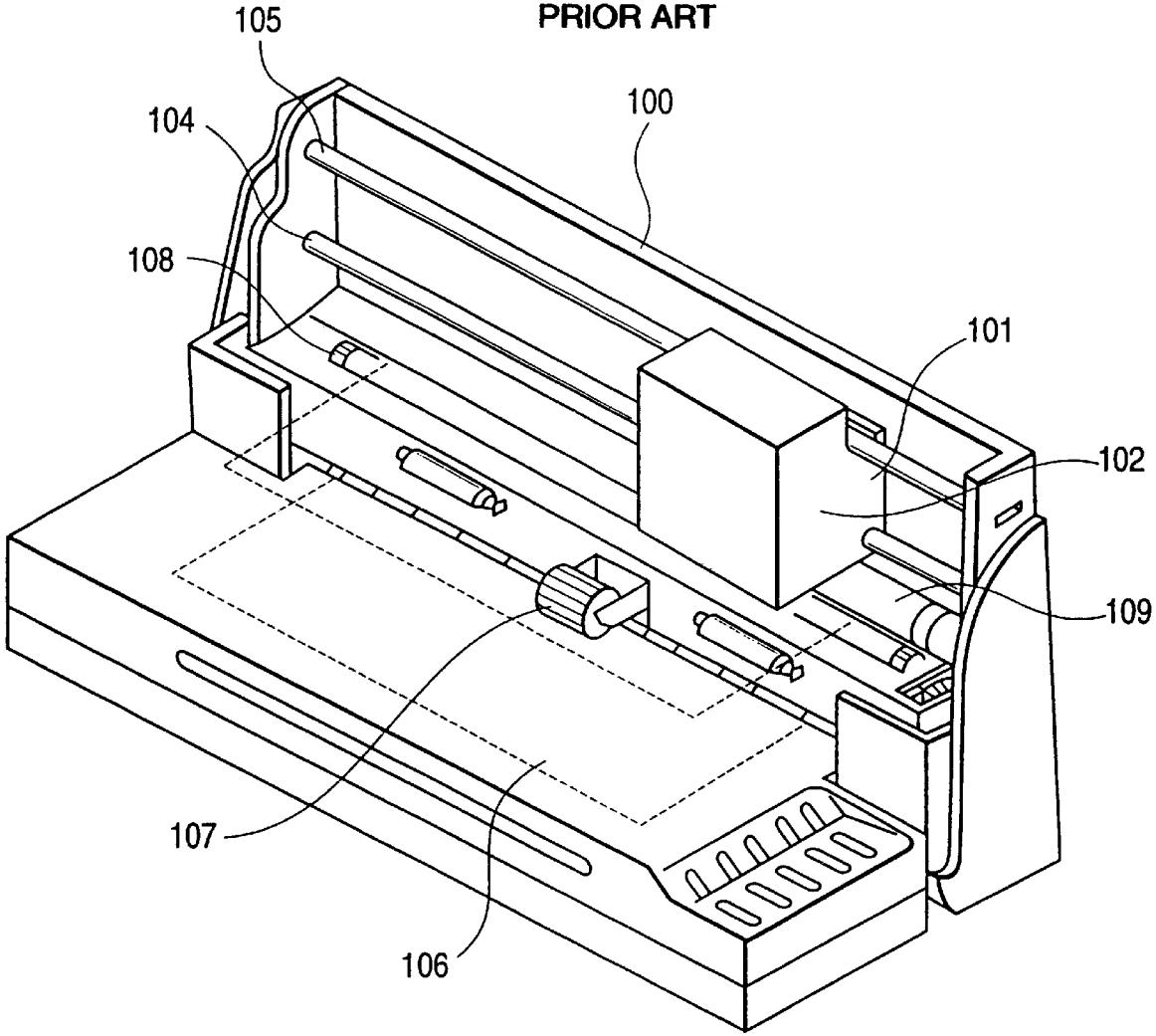
FIG. 25 PRIOR ART

FIG. 25 is a perspective view which shows the general jet recording apparatus conventionally in use.

Figure 26B:
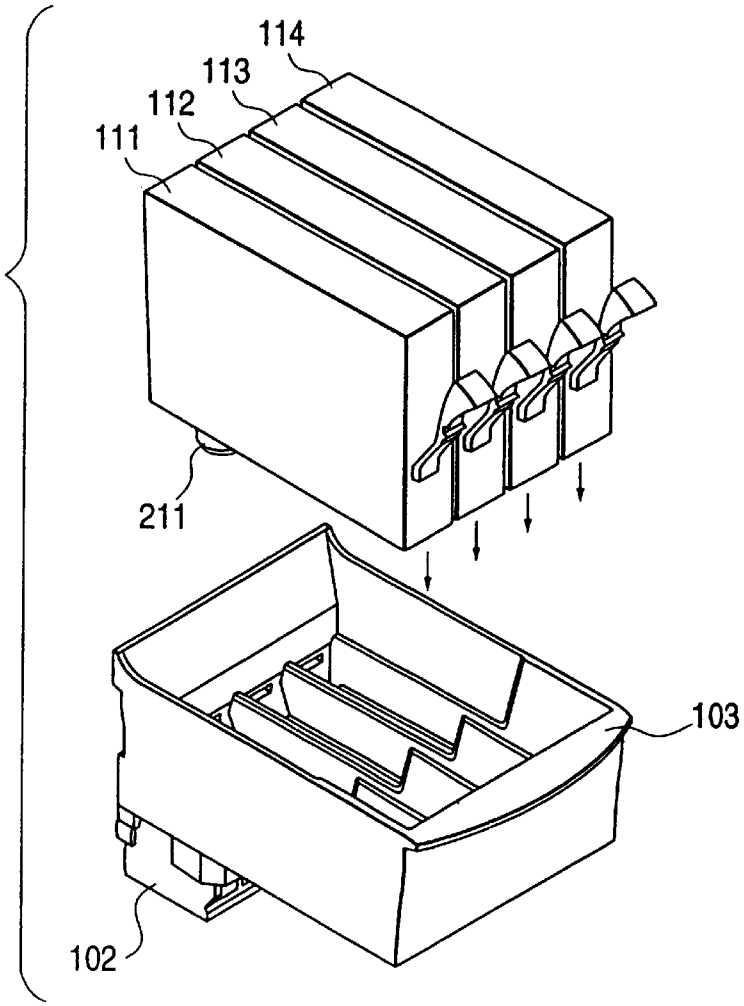
FIG. 26B PRIOR ART
Figure 26A:
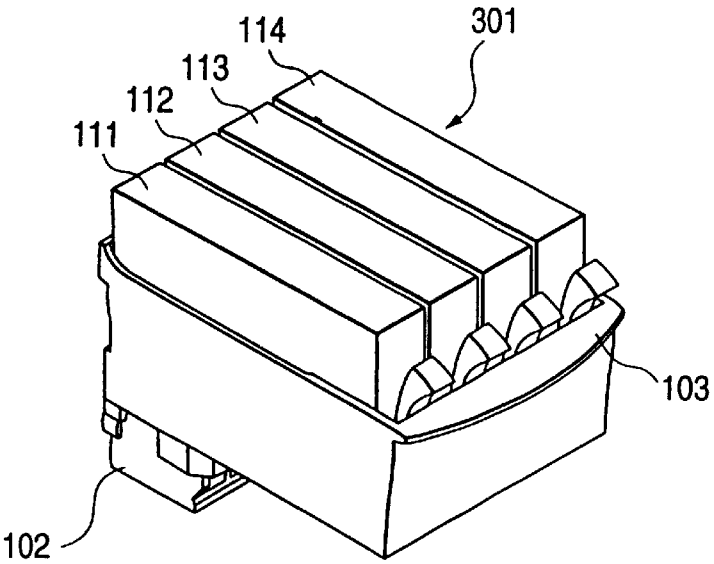
FIG. 26A PRIOR ART

FIGS. 26A and 26B are perspectives views which illustrate the state of the conventional ink Jet head cartridge.

Figure 27:
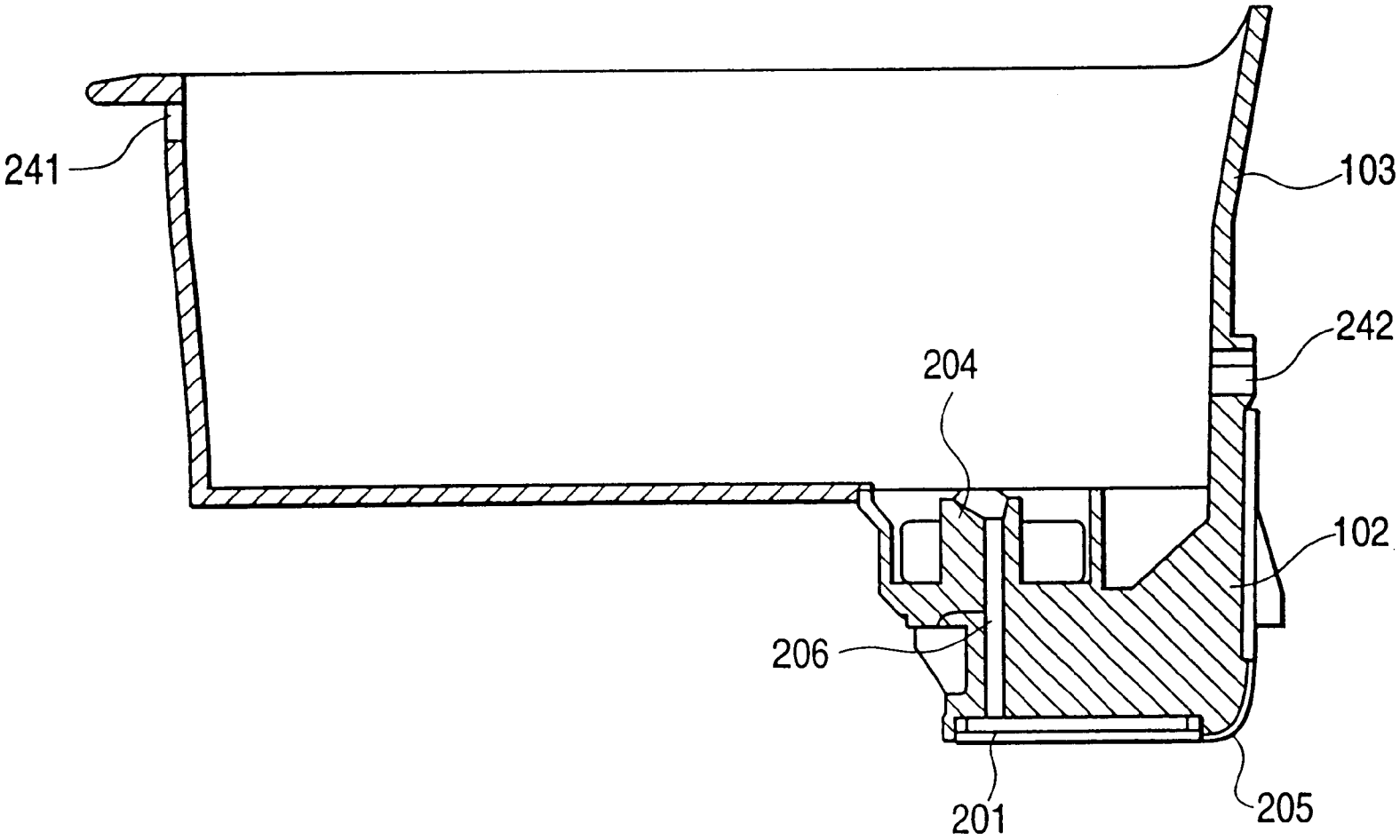
FIG. 27 PRIOR ART

FIG. 27 is a cross-sectional view which shows the conventional ink jet head cartridge.

Figure 28A:
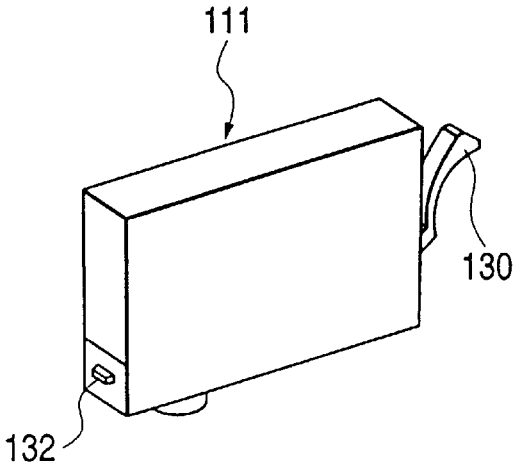
FIG. 28A PRIOR ART
Figure 28B:
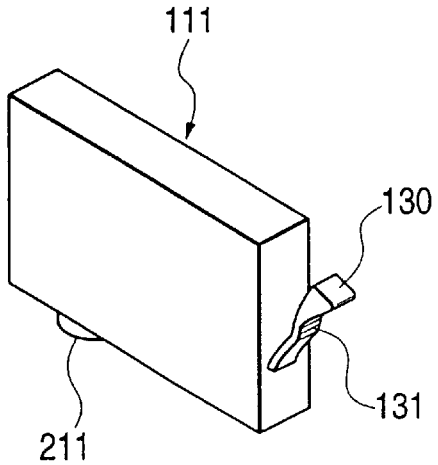
FIG. 28B PRIOR ART
Figure 28C:
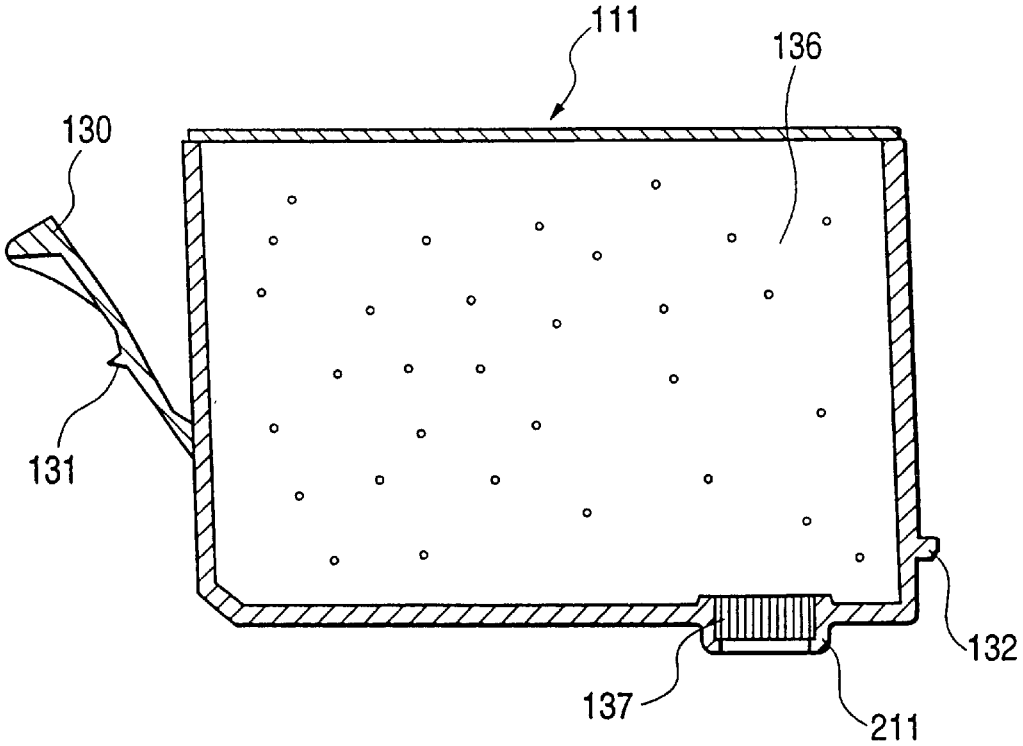
FIG. 28C PRIOR ART

FIGS. 28A, 28B and 28C are detailed views which illustrate the ink tank of the ink jet head cartridge shown in FIG. 27.

Figure 29A:
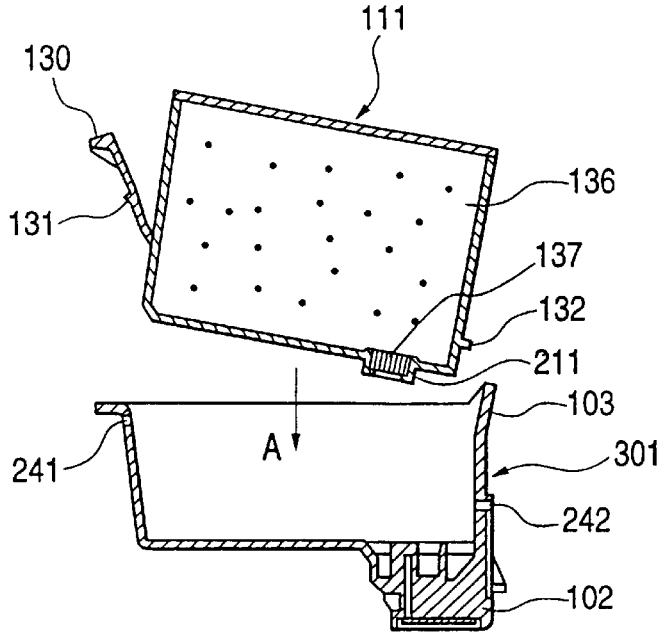
FIG. 29A PRIOR ART
Figure 29B:
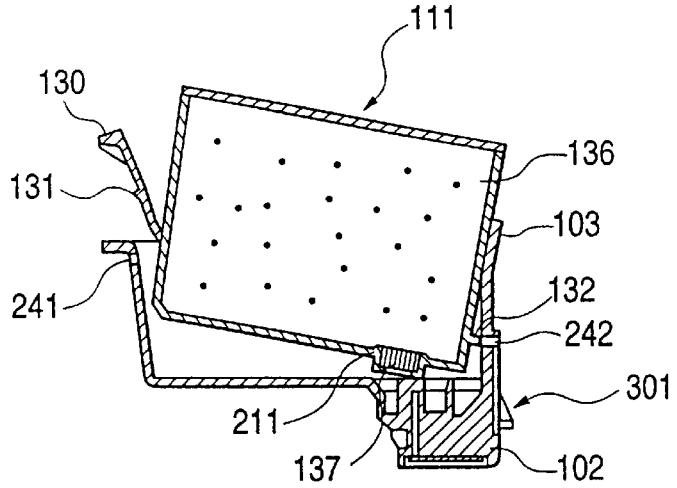
FIG. 29B PRIOR ART
Figure 29C:
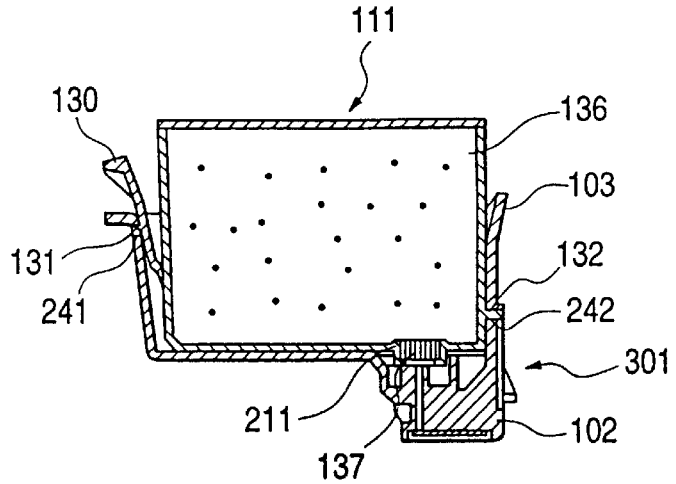
FIG. 29C PRIOR ART

FIGS. 29A, 29B and 29C are cross-sectional views which illustrate the state where the ink tank is installed on the tank holder for the conventional ink jet head cartridge shown in FIGS. 26A and 26B.

DETAILED DESCRIPTION OF THE PREFERRED EMBODIMENTS

Hereinafter, with reference to the accompanying drawings, the description will be made of the embodiments in accordance with the present invention.

In accordance with the present embodiment, two different kinds head cartridges are installed on the carriage of a recording apparatus as shown in FIG. 25, for example. The two head cartridges are the head cartridge for photographic use having ink tanks of magenta and cyan of lighter density each, and black ink, and the color head cartridge capable of discharging yellow, magenta, and cyan ink. With this combination, the recording apparatus can print using six color ink, and also, performs the photographic printing beautifully or performs text printing at high speeds by exchanging the head cartridge for photographic use with the head cartridge for use of black color having only the black ink tank or print in business colors at high speeds.

Figure 1:
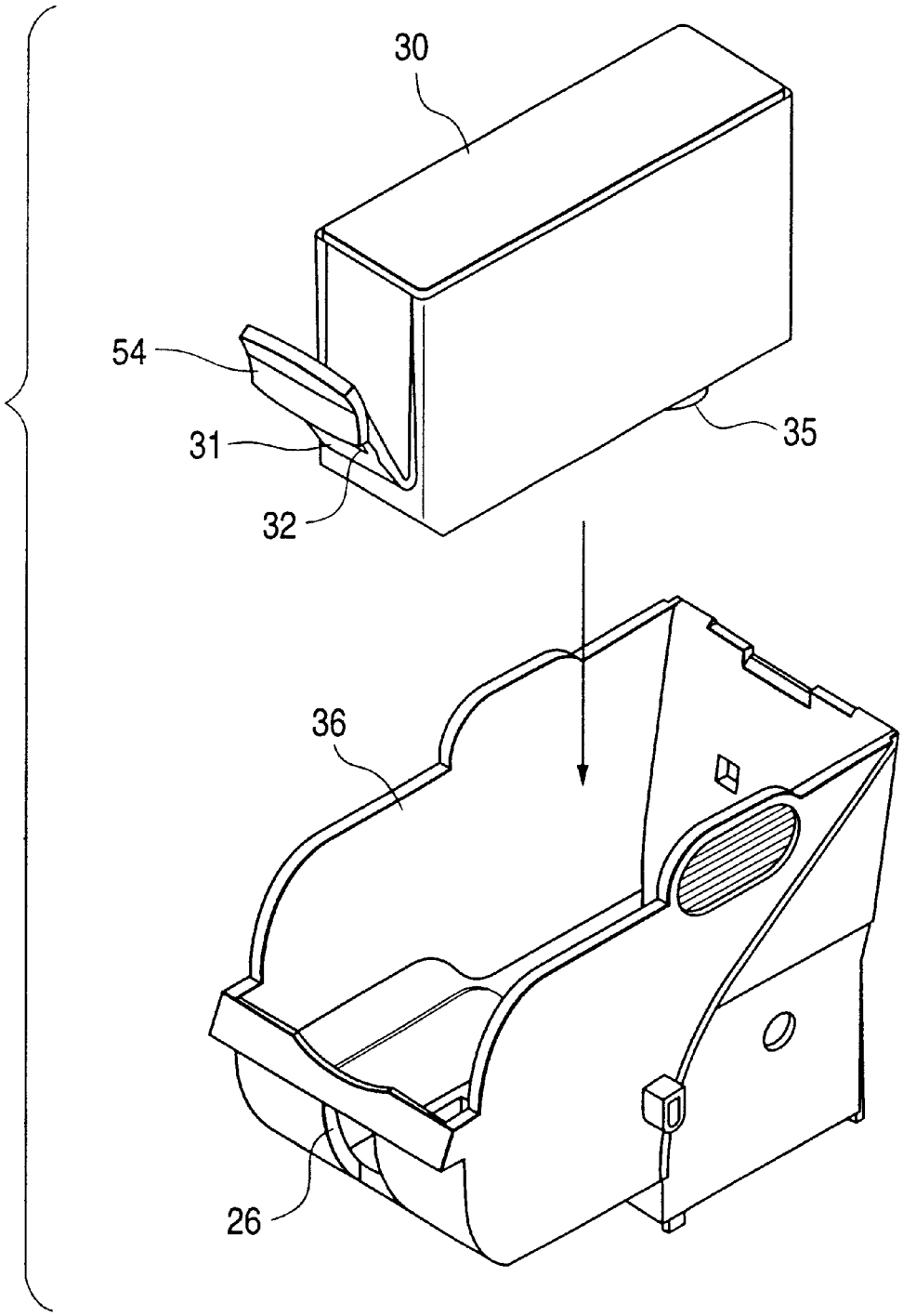
FIG. 1 is a perspective view which shows one example of the ink tank and the tank holder which form the ink jet head cartridge for use of black ink to which the present invention is applicable, observed from the front face side thereof.
Figure 2:
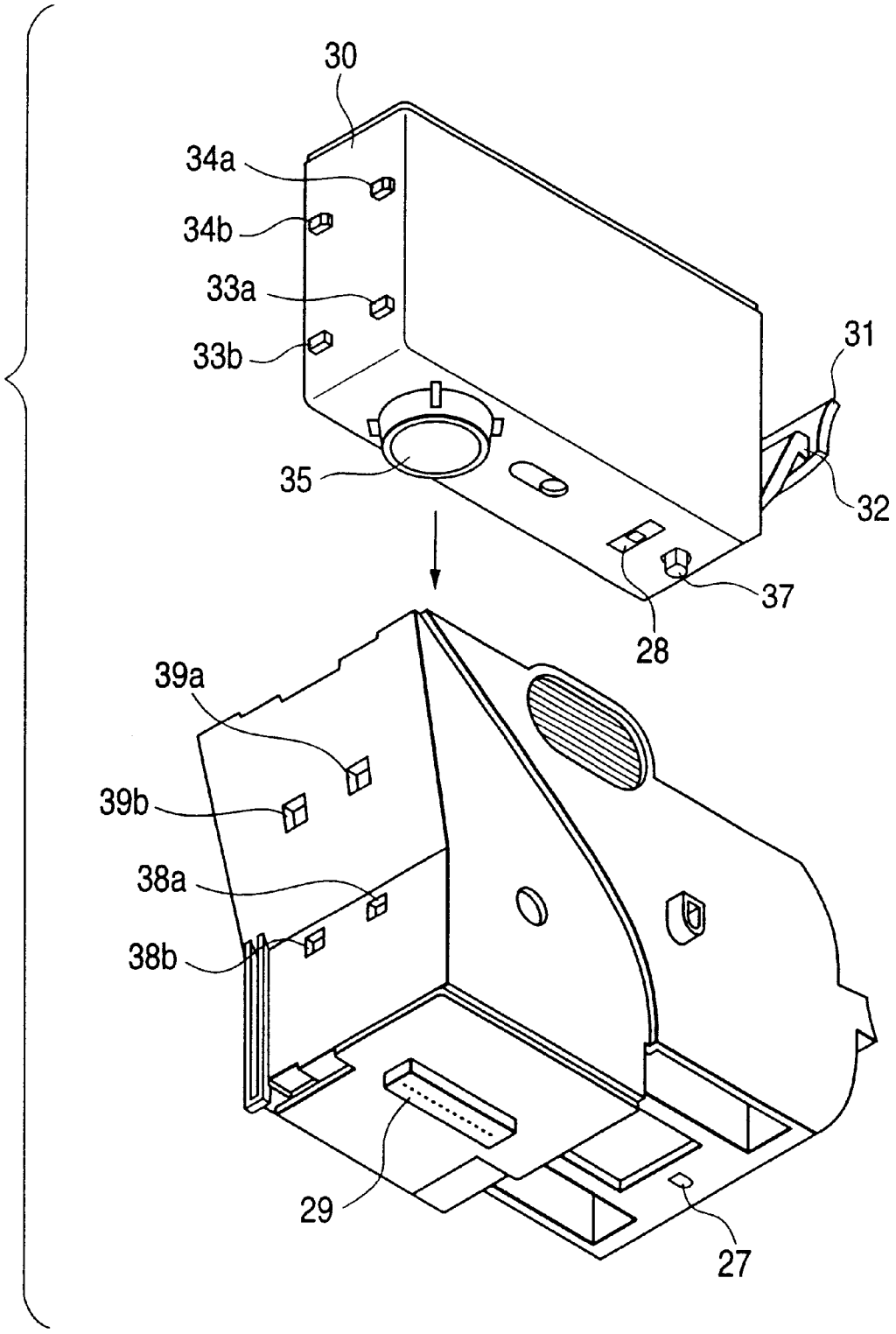
FIG. 2 is a pespective view which shows one example of the ink tank and the tank holder which for,m the ink jet head cartridge for use of black ink to which the present invention is applicable, observed from the back face side thereof.

FIG. 1 is a view which shows the head cartridge for use of black color in accordance with a first embodiment of the present invention, observed diagonally from the upper right side of the front face. FIG. 2 is a view which shows the head cartridge for use of black color, observed diagonally from the lower left side of the back face thereof.

The head cartridge for use of black color of the present embodiment shown in FIG. 1 and FIG. 2 is structured with a tank holder 36 for use of black color which is provided with an ink tank 30 of a larger capacity for black ink use, and an ink jet head 29, and arranged to hold the ink tank 30 detachably. On one side face of the ink tank 30, a movable member 31 is arranged with a tongue 54 and a first nail 32. On the other side face of the ink tank 30, second nails 33*a* and 33*b* are arranged. Further, above the second nails 33*a* and 33*b* on the other side of the ink tank 30, third nails 34*a* and 34*b* are arranged.

On the lower part of the ink tank 30, there are provided the ink supply port 35 which is cylindrically extruded from the bottom face of the tank; positioning pin 37 used when the ink tank 30 is installed on the tank holder 36; and a prism 28 used for detecting the ink remainders in the tank.

Also, for the tank holder 36, the first hole 26, and the second holes 38*a* and 38*b* are formed to engage with the first nail 32 and the second nails 33*a* and 33*b*, respectively, when the ink tank 30 is installed on the tank holder 36. Further, the third holes 39*a* and 39*b* are formed on the tank holder 36, which are used for provisionally dropping the third nails 34*a* and 34*b* into them in the process of positioning when the ink tank 30 is installed on the tank holder 36. Furthermore, on the lower part of the tank holder 36, the positioning hole 27 is arranged to engage with the positioning pin 37 of the ink tank 30.

Figure 3:
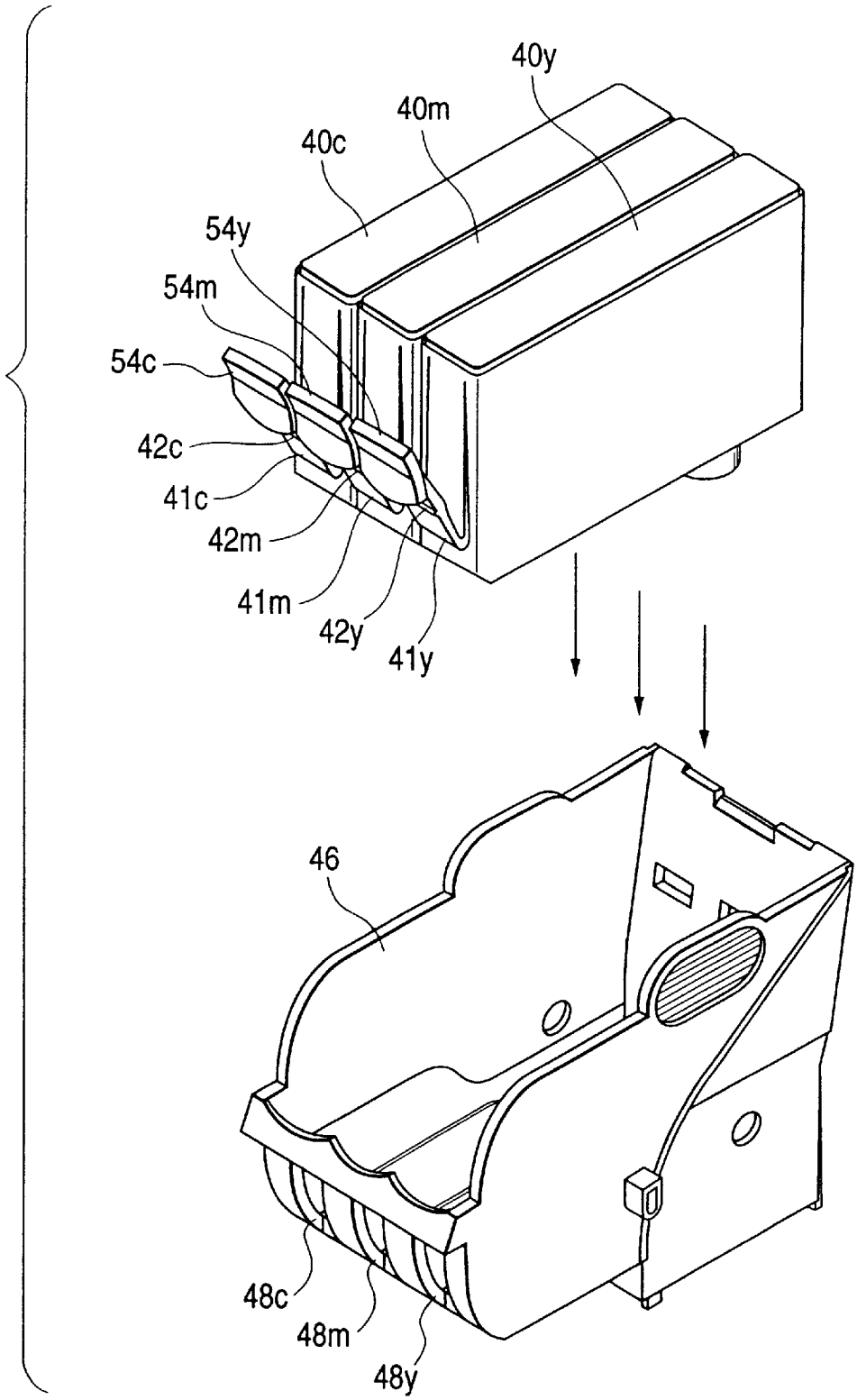
FIG. 3 is a perspective view which shows one example of the ink tanks and the tank holder which form the ink jet head cartridge for use of colors to which the present invention is applicable, observed from the front face side thereof.
Figure 4:
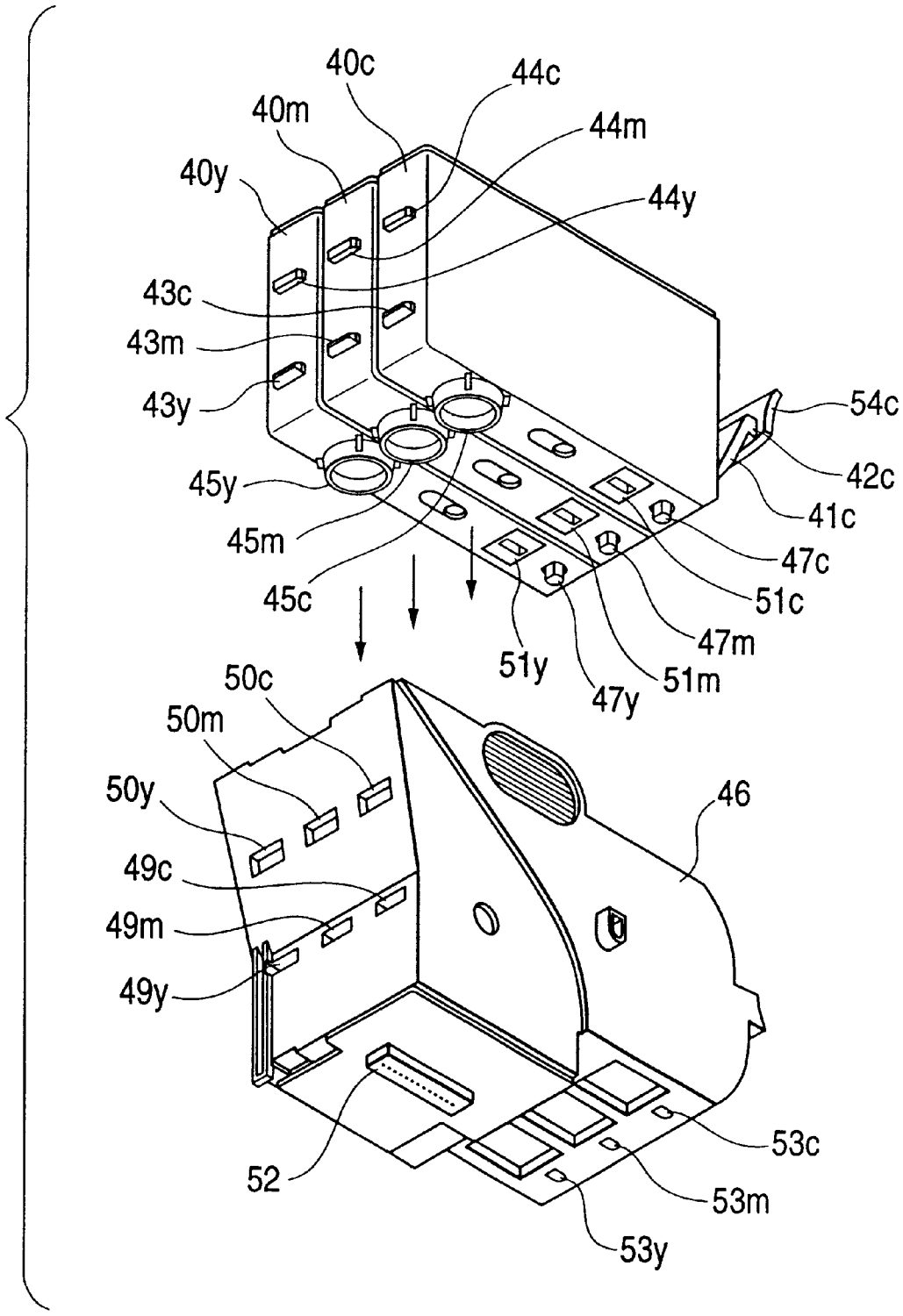
FIG. 4 is a perspective view which shows one example of the ink tanks and the tank holder which form the ink jet head cartridge for use of colors to which the present invention is applicable, observed from the back face side thereof.

On the other hand, FIG. 3 is a view which shows the head cartridge for use of colors in accordance with a first embodiment of the present invention, observed diagonally from the upper right side of the front face. FIG. 4 is a view which shows the head cartridge for use of colors, observed diagonally from the lower left side of the back face thereof.

The head cartridge for use of colors shown in FIG. 3 and FIG. 4 is structured with the tank holder 46 which is provided with the cyan ink tank 40*c*, the magenta ink tank 40*m*, the yellow ink tank 40*y*, and the ink jet head, and which can detachably hold the ink tanks 40*c*, 40*m*, and 40*y* individually. In the same manner as the ink tank for use of black color, on one side face of each of the color ink tanks 40*c*, 40*m*, and 40*y*, the movable levers 41*c*, 41*m*, and 41*y* are arranged, respectively. Each of the movable levers is provided with each of the tongues 54*c*, 54*m*, and 54*y*, as well as the first nails 42*c*, 42*m*, and 42*y*.

On the other side face of each of the ink tanks 40*c*, 40*m*, and 40*y*, the second nails 43*c*, 43*m*, and 43*y* are arranged, respectively. Further, the third nails 44*c*, 44*m*, and 44*y* are arranged above the second nails 43*c*, 43*m*, and 43*y* on the other side face of each of the ink tanks 40*c*, 40*m*, and 40*y*, respectively.

On the lower part of the ink tank 40*c* (40*m* and 40*y*), there are provided the ink supply port 45*c* (45*m* and 45*y*) which is cylindrically extruded from the bottom face of the tank; positioning pin 47*c* (47*m* and 47*y*) used when the ink tank 40*c* (40*m* and 40*y*) is installed on the tank holder 46; and a prism 51*c* (51*m* and 51*y*) used for detecting the ink remainders in the tank.

Also, for the tank holder 46, the first hole 48*c* (48*m* and 48*y*), and the second hole 49*c* (49*m* and 49*m*) are formed to engage with the first nail 42*c* (42*m* and 42*y*) and the second nail 43*c* (43*m* and 43*y*), respectively, when the ink tank 40*c* (40*m* and 40*y*) is installed on the tank holder 46. Further, the third hole 50*c* (50*m* and 50*y*) is formed on the tank holder 46, which is used for provisionally dropping the third nail 44*c*, (44*m* and 44*y*) into it in the positioning process when the ink tank 40*c* (40*m* and 40*y*) is installed on the tank holder 46. Furthermore, on the lower part of the tank holder 46, the positioning hole 53*c* (53*m* and 53*y*) is arranged to engage with the positioning pin 47*c* (47*m* and 47*y*) of the ink tank 40*c*.

In this respect, the head cartridge for photographic use is structure in the same manner as the head cartridge for use of colors.

Also, for the present embodiment, the movable lever and the engagement nail (the second nail) are formed integrally with the tank main body by means of molding. Then, polypropylene is adopted for the molding material thereof because it has excellent resistance to ink, gas barrier properties, and transparency, as well as it is inexpensive.

Now, with reference to FIGS. 5A to 5F, the description will be made of the procedures in which the ink tank is installed (set) on the tank holder of the ink jet head cartridge with the ink jet head cartridge for use of black ink taken as an example.

Figure 5A:
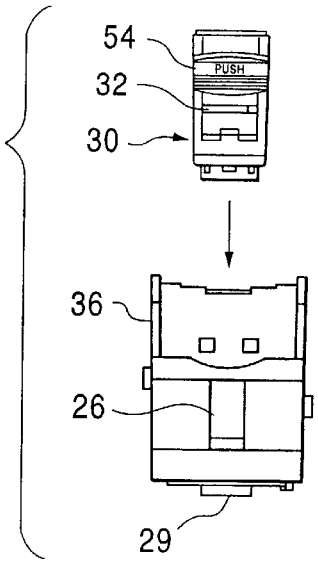
FIGS. 5A, 5B, 5C, 5D, 5E and 5F are perspective views which illustrate the respective states where the ink tank is installed on the tank holder for the ink jet head cartridge for use of black color to which the present invention is applicable.
Figure 5B:
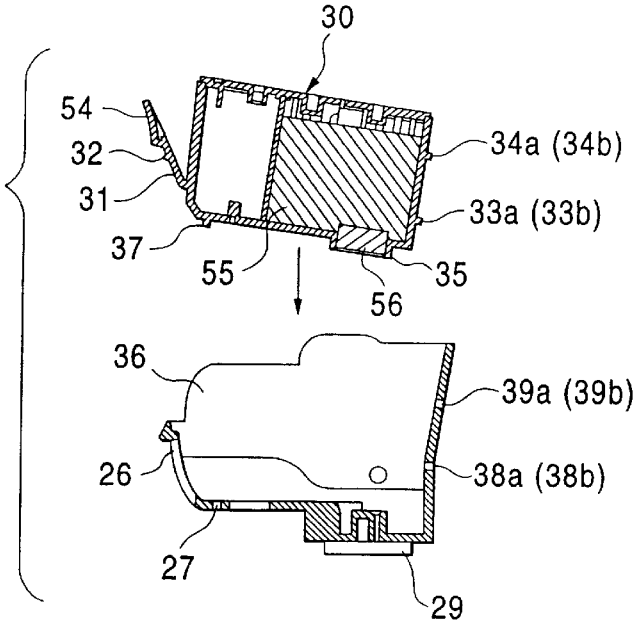

At first, as shown in FIGS. 5A and 5B, the user directs the face of the ink tank 30 on the ink supply port 35 side to the opening on the upper surface of the tank holder 36, and at the same time, he places the ink tank 30 so that the second nails 33*a* and 33*b* are inclined downward, thus inserting the ink tank 30 into the interior of the tank holder 36 as indicated by an arrow.

Figure 5C:
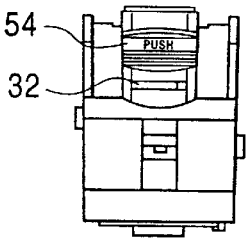
Figure 5D:
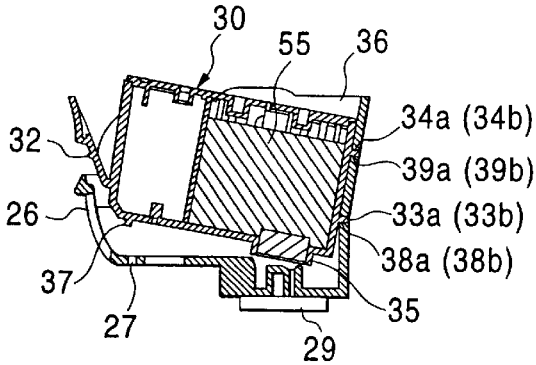

Then, as shown in FIGS. 5C and 5D, the ink tank 30 is inserted along with the inclination of the side face of the tank holder 36 on the right side in FIGS. 5C and 5D. Then, the third nails 34*a* and 34*b* of the ink tank 30 are allowed to engage with the third holes 39*a* and 39*b* of the tank holder 36, and the second nails 33*a* and 33*b* engage with the second holes 38*a* and 38*b* of the tank holder 36.

Figure 5E:
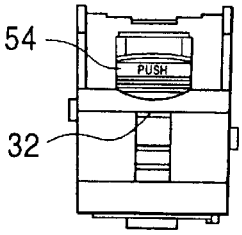
Figure 5F:
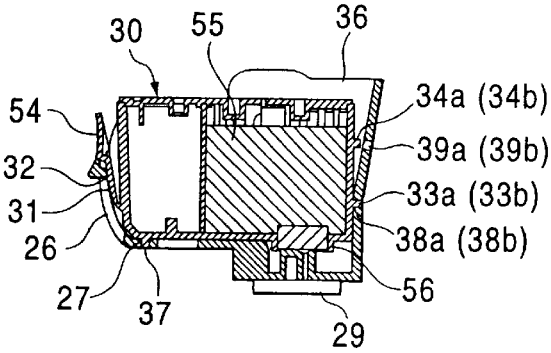

Further, with the second nails 33*a* and 33*b* that engage with the second holes 38*a* and 38*b* of the tank holder 36 as the fulcrum, the ink tank 30 is being rotated to allow the ink tank 30 to be pressed into the interior of the tank holder 36. In this manner, as shown in FIGS. 5E and 5F, the movable lever 31 is bent inward so that the first nail 32 engages the first hole 26 of the tank holder 36, and at the same time, the positioning pin 37 of the ink tank 30 is inserted into the positioning hole 27 of the tank holder 36. Thus, the ink tank 30 is fixed to the tank holder 36 in good precision.

In this state, ink retained in the ink absorbent 55 is introduced to the ink jet head 29 through the joint member 56 of the ink supply port 35, and then, discharged from each of the discharge ports (not shown) by the application of energy generated by each of electrothermal converting means (not shown) arranged in the head 29.

Here, when the ink tank 30 is removed, the movable lever 31 is bent inward to enable the first nail 32 to be drawn out from the first hole 26 of the tank holder 36, and the tongue 54 of the movable lever 31 is pulled up to remove the ink tank 30 easily from the tank holder 36.

The fundamental structure of the ink jet head cartridge of the present invention, and the installation method have been described as above, but in conjunction with the accompanying drawings, the specific description will be made of the structure thereof as given below.

(First Embodiment)

Figure 6B:
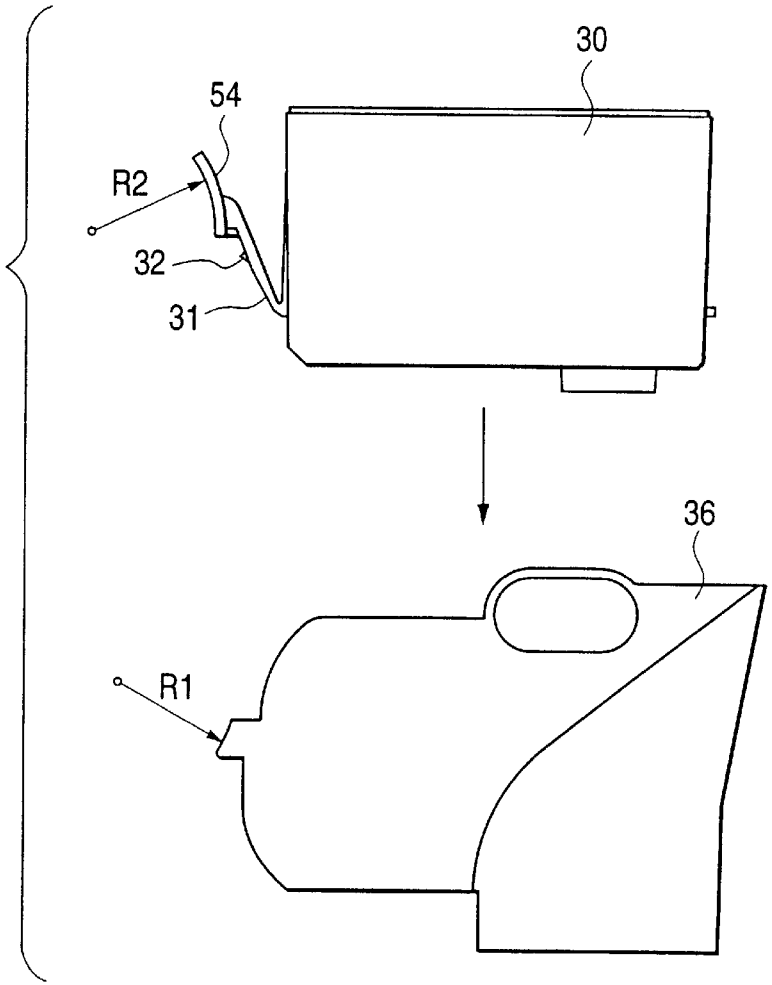
FIGS. 6A and 6B are views which illustrate the ink tank and the tank holder which form the ink jet head cartridge for use of black color to which the present invention is applicable.
Figure 6A:
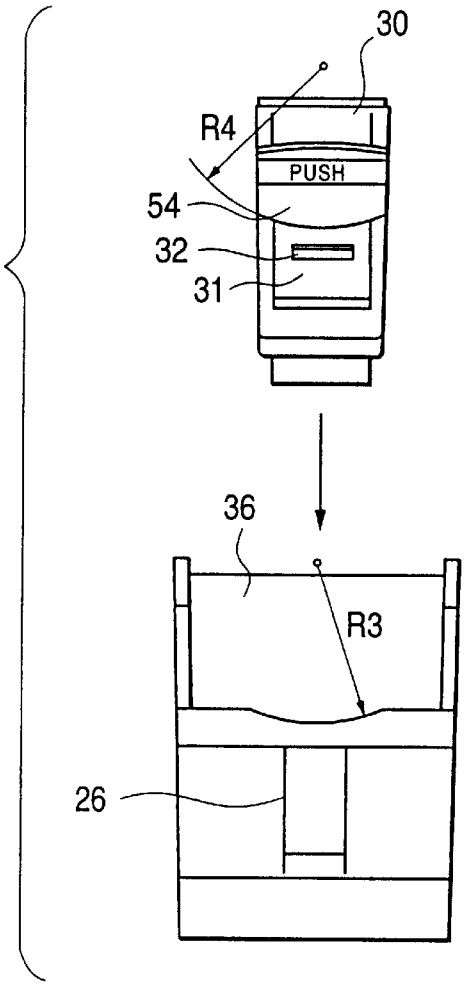

FIG. 6A is a front view of the ink tank and the tank holder which form the ink jet head cartridge for use of black color in accordance with the present embodiment of the invention. FIG. 6B is the side view of the ink tank and the hank holder.

As shown in FIG. 6A, the lower part of the tongue 54 of the movable lever 31 on the front face of the ink tank 30 is extruded to present the convex arc regulated by the radius dimension R4 in the width direction of the ink tank 30. Also, the location where the movable lever 31 is arranged for the ink tank 30 is curved on the front face of the tank holder 36, which is in the form of arc regulated by the radius dimension R3 (≅R4) in the width direction of the tank holder 36.

Further, as shown in FIG. 6B, the tongue 54 of the movable lever 31 is bent in the direction toward the back face of the ink tank to be in an arc regulated by the radius dimension R2 in the back face direction of the ink tank 30. Also, the location where the movable lever 31 is arranged for the ink tank 30 is curved in the back face direction of the tank holder 36, which is in the form of arc regulated by the radius dimension R1 (≅R2) in the back face direction of the tank holder 36.

In this manner, the tongue 54 of the ink tank 30 is in the form of arc regulated by the R2 to make it possible to disperse the acting force exerted at the time of ink tank removal both to the acting forces of the forward pushing operation of the movable member 31 and pushing up operation of the ink tank in good balance. As a result, the ink tank can be removed with a slight acting force without any excessive force used for removing the ink tank. There is no possibility, either, that the positioning pin arranged on the bottom face of the ink tank and the positioning hole arranged for the tank holder are allowed to rub each other unnaturally, hence preventing the positioning pin or the positioning hole from being cut off so as to minimize the drawback that may be brought to the execution of perfect positioning.

Figure 7B:
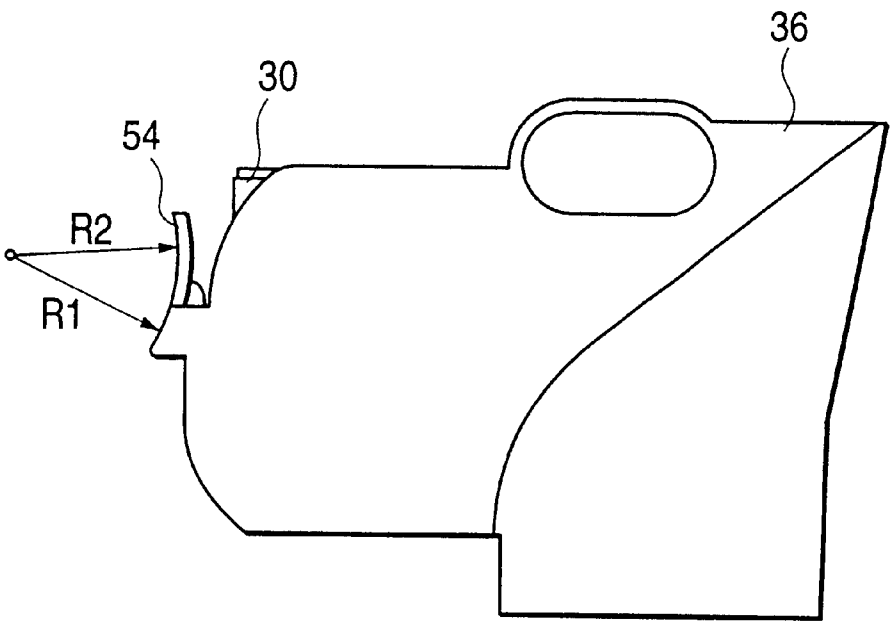
FIGS. 7A and 7B are views which illustrate the state where the ink tank and the tank holder are installed correctly for the ink jet head cartridge for use of black color to which the present invention is applicable.
Figure 7A:
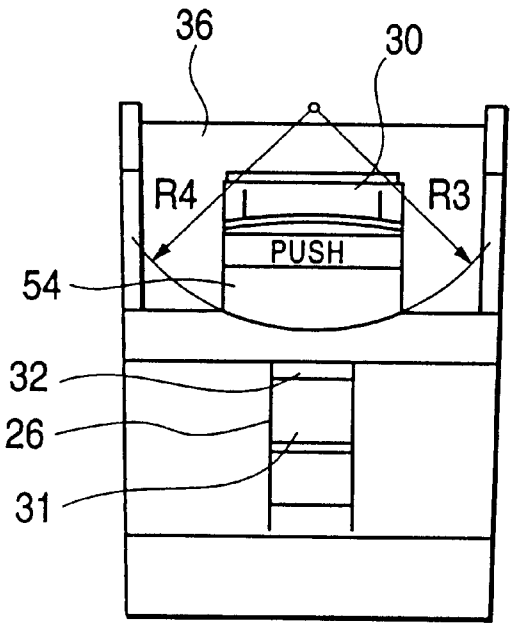
Figure 8B:
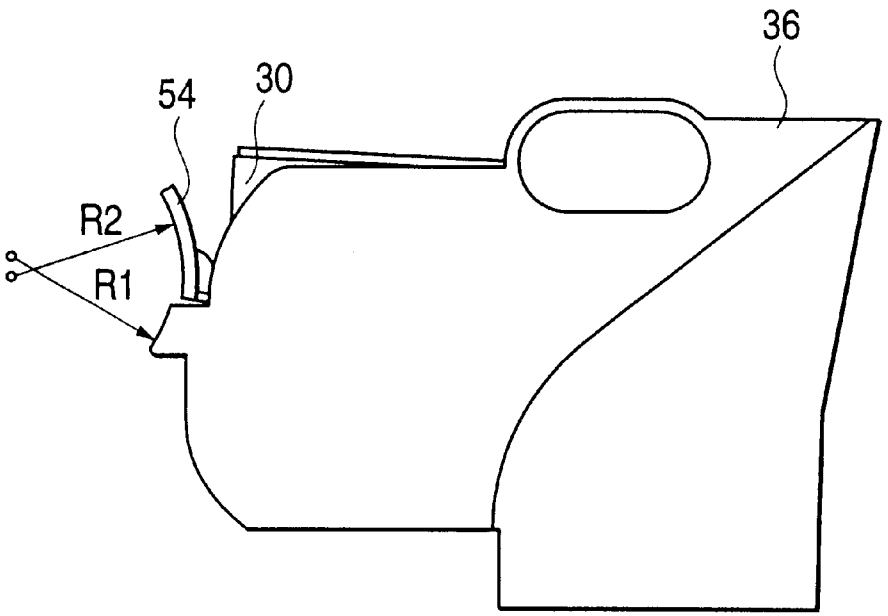
FIGS. 8A and 8B are views which illustrate the state where the ink tank and the tank holder are installed imperfectly for the ink jet head cartridge for use of black color to which the present invention is applicable.
Figure 8A:
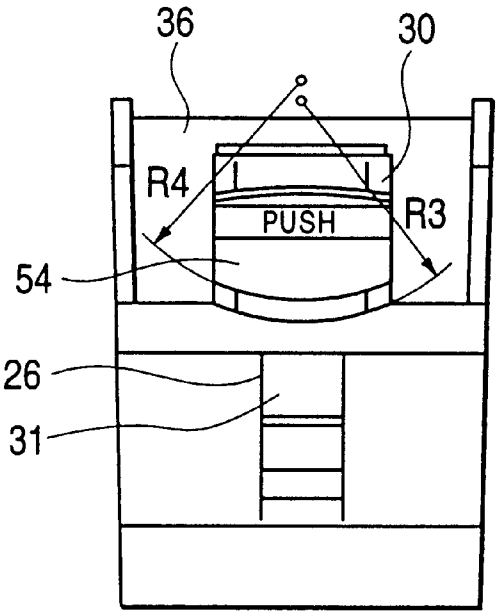

FIG. 7A is a front view which shows the state that the ink tank 30 is correctly installed on the tank holder 36. FIG. 7B is the side view thereof. FIG. 8A is a front view which shows the state that the ink tank 30 is imperfectly installed on the tank holder 36. FIG. 8B is the side view thereof.

As shown in FIG. 7A, if the user installs the ink tank 30 on the tank holder 36 correctly, the arcs of the radius dimensions R3 and R4 become coaxial when observed from the front side. Then, only a specific gap (dimensional tolerance) is formed between the convex arc portion on the lower part of the tongue 54 of the movable member 31, and the concave arc portion of the tank holder 36, and both of them are in agreement with each other.

Further, when observed from the side face, the radius dimensions R1 and R2 are coaxial as shown in FIG. 7B. Then, the tank holder 36 and the tongue 54 of the ink tank are connected smoothly in the form of arc.

In other words, the user can recognize that the tank holder 36 and the ink tank 30 are coaxially in the arc with the smoothly connected outer appearance thereof when observed either from the front side or from the side face. Thus, the installation of the ink tank can be confirmed by eye-sight to perform the exact installation more reliably.

If, on the contrary, the user should install the ink tank 30 on the tank holder 36 imperfectly, the radius dimensions R3 and R4 do not present the coaxial condition which is indicated in FIG. 8A when observed from the front side, that is, an unnatural gap is formed between the convex arc portion of the lower part of the tongue 54 and the concave arc portion of the tank holder 36. Further, when observed from the side face, the radius dimensions R1 and R2 do not present the coaxial condition which is indicated in FIG. 8B, and the tank holder 36 and the tongue 54 of the ink tank 30 are disconnected. Therefore, the user can easily recognize that the ink tank 30 and the tank holder 36 are installed incorrectly. Then, the user can operate again until the ink tank 30 and the tank holder 36 are in the state as shown in FIGS. 7A and 7B.

In accordance with the present embodiment, the radius dimensions of the lower part of the tongue 54 of the movable lever 31 are set as follows:

R2=20 mm, R4=25 mm

The radius dimensions of the holder 36 are:

R1=20 mm, R3=25.5 mm where the R3 is made longer than the R4 by 0.5 mm.

In this way, the user can easily confirm whether or not the ink tank is installed on the tank holder correctly.

(Second Embodiment)

Here, the description will be made of the ink jet head cartridge of three-color integrated type where three kinds of ink tanks can be installed on one tank holder, such as the ink jet head cartridge for use of colors.

Figure 9B:
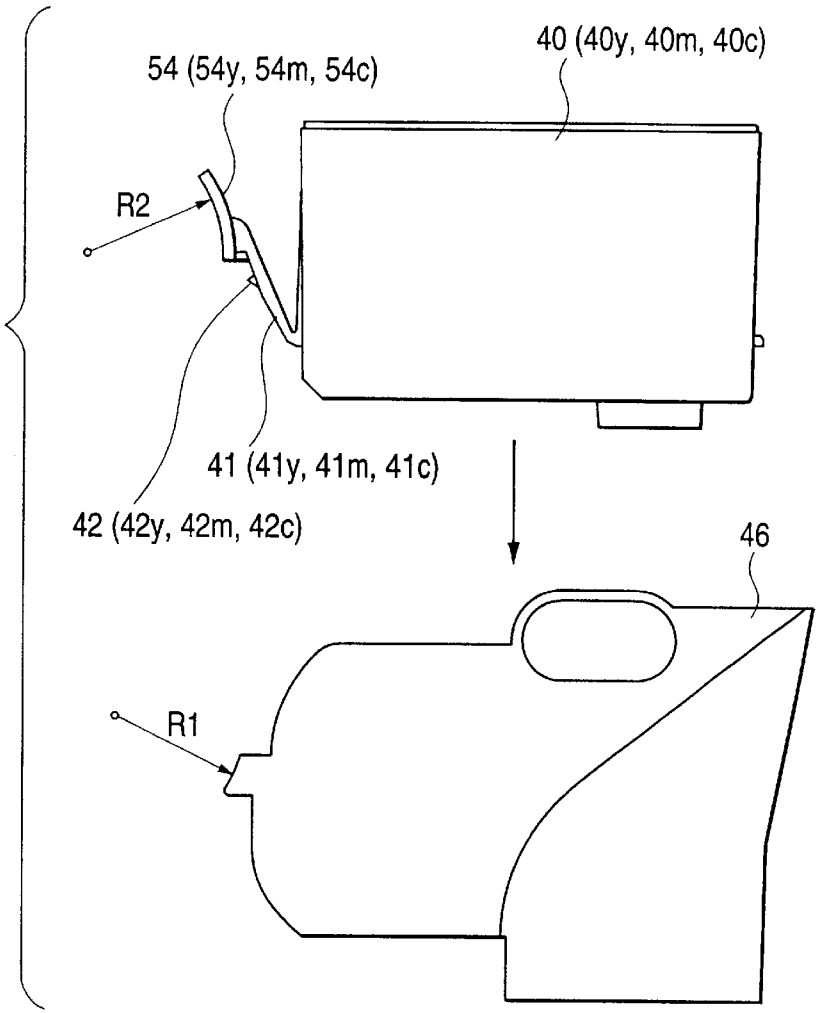
FIGS. 9A and 9B are views which illustrate the ink tanks an the tank holder which form the ink jet head cartridge for use of colors to which the present invention is applicable.
Figure 9A:
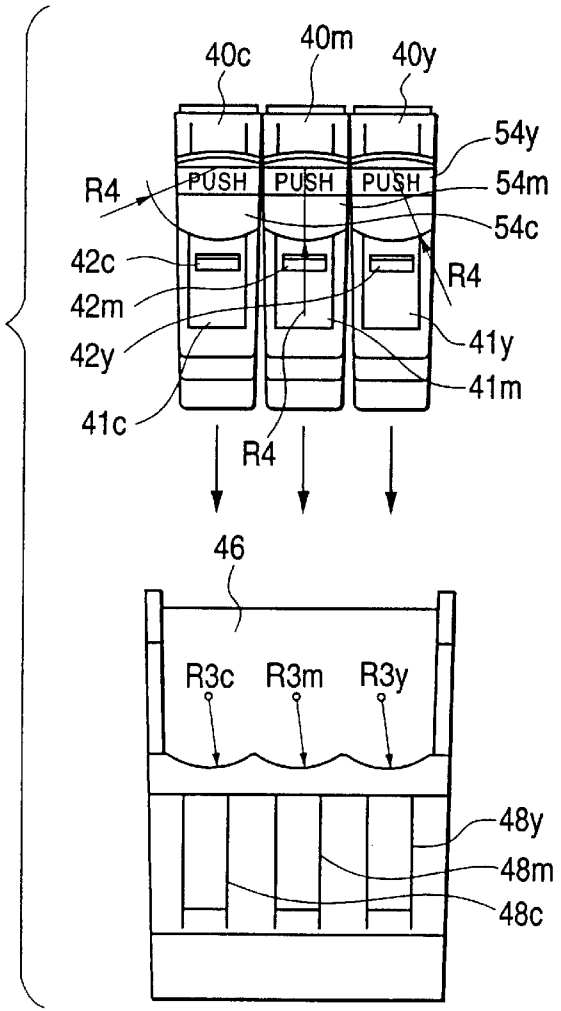

FIG. 9A is a front view which shows the ink tanks and the tank holder that constitute the ink jet head cartridge for use of colors in accordance with a second embodiment of the present invention. FIG. 9B is the side view thereof.

As shown in FIG. 9A, each of the lower parts of the tongues 54*y*, 54*m*, and 54*c* of the movable levers 41*y*, 41*m*, and 41*c* on each front face of the color ink tanks 40*y*, 40*m*, and 40*c* is extruded, respectively, to present the convex arc, which is all regulated by the radius dimension R4 in the width direction of each ink tank. Also, the location where each of the movable levers 41*y*, 41*m*, and 41*c* are arranged for each of the ink tanks 40*y*, 40*m*, and 40*c* is curved on the front face of the tank holder 46 in the form of arc, which is all regulated by the radius dimension R3 (≅R4) in the width direction of the tank holder, respectively.

Further, as shown in FIG. 9B, each of the tongues 54*y*, 54*m*, and 54*c* of the movable levers 41*y*, 41*m*, and 41*c* is bent in the direction toward the back face of each ink tank to be in an arc, which is all regulated by the radius dimension R2 in the back face direction of each ink tank. Also, the location where each of the movable levers 41*y*, 41*m*, and 41*c* is arranged for each of the color ink tanks 40*y*, 40*m*, and 40*c* is curved in the back face direction of the tank holder 46 in the form of arc, which is all regulated by the radius dimension R1 (≅R2) in the back face direction of the tank holder 46.

Figure 10B:
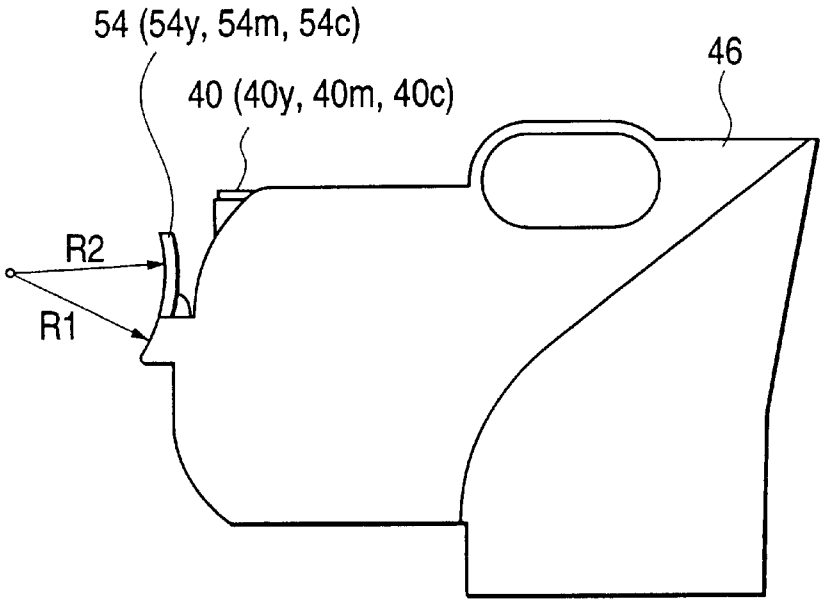
FIGS. 10A and 10B are views which illustrate the state where the ink tanks and the tank holder are installed correctly for the ink jet head cartridge for use of colors to which the present invention is applicable.
Figure 10A:
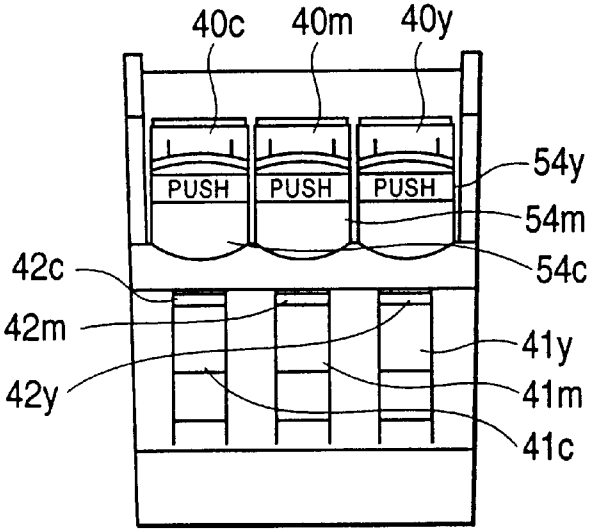
Figure 11B:
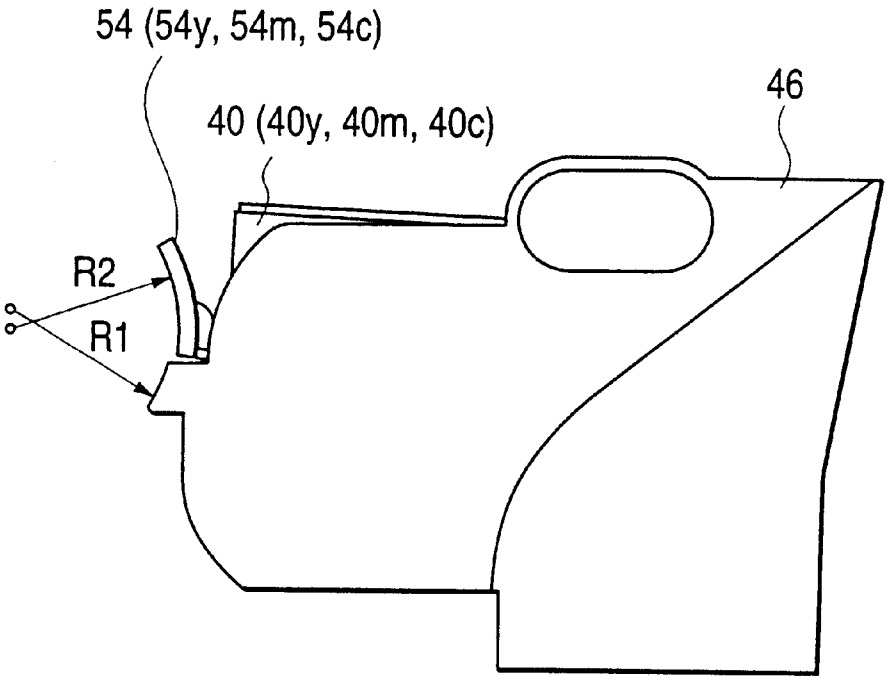
FIGS. 11A and 11B are views which illustrate the state where the ink tanks and the tank holder are installed imperfectly for the ink jet head cartridge for use of colors to which the present invention is applicable.
Figure 11A:
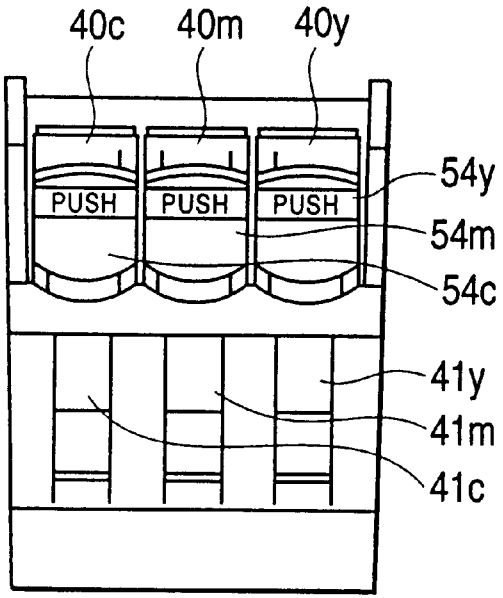
Figure 12B:
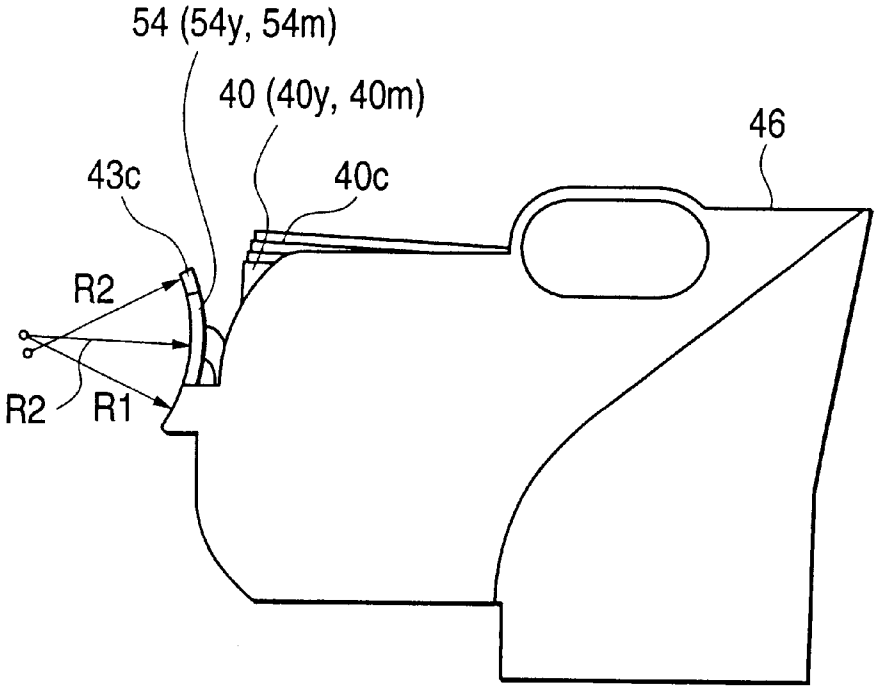
FIGS. 12A and 12B are views which illustrate the state where one of the ink tanks is installed imperfectly on the tank holder for the ink jet head cartridge for use of colors to which the present invention is applicable.
Figure 12A:
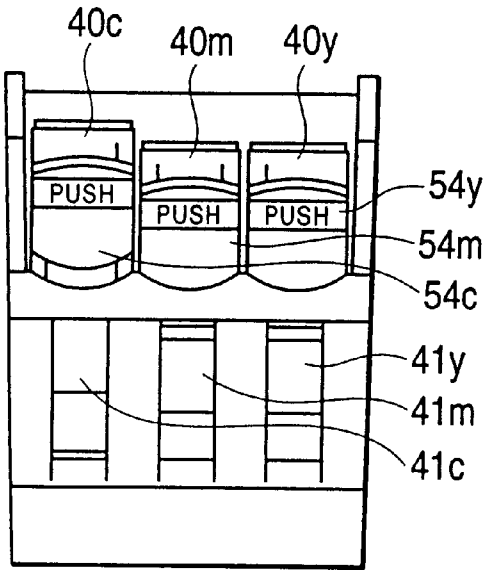

FIG. 10A is a front view which shows the state that each of the ink tanks 40*y*, 40*m*, and 40*c* is correctly installed on the tank holder 46. FIG. 10B is the side view thereof. FIG. 11A is a front view which shows the state that all of the ink tanks 40*y*, 40*m*, and 40*c* are imperfectly installed on the tank holder 46. FIG. 11B is the side view thereof. FIG. 12A is a front view which shows the state that one of the ink tanks 40*y*, 40*m*, and 40*c* (in FIG. 12A, the ink tank 40*c*) is imperfectly installed on the tank holder 46. FIG. 12B is the side view thereof.

As shown in FIG. 10A, if the user installs the ink tanks 40*y*, 40*m*, and 40*c* on the tank holder 46 correctly, the arcs of the radius dimensions R3 and R4 become coaxial when observed from the front side. Then, only a specific gap (dimensional tolerance) is formed between the convex arc portion on the lower part of the tongues 34*y*, 54*m*, and 54*c* of the movable members 41*y*, 41*m* and 41*c* and the concave arc portion of the tank holder 46 where the tongues 54*y*, 54*m*, and 54*c* are arranged, and both of the arc portions are in agreement with each other.

Further, when observed from the side face, the radius dimensions R1 and R2 are coaxial as shown in FIG. 10B. Then, the tank holder 46 and the tongues 54*y*, 54*m*, and 54*c* of the ink tanks are connected smoothly in the form of arc.

In other words, the user can recognize that the tank holder 46 and each of the color ink tanks 40*y*, 40*m*, and 40*c* are coaxially in the form of arc, respectively, with the smoothly connected outer appearance thereof.

If, on the contrary, the user should install all the ink tanks 40*y*, 40*m*, and 40*c* on the tank holder 46 imperfectly, the radius dimensions R3 and R4 do not present the coaxial condition which is indicated in FIG. 11A when observed from the front side, and an unnatural gap is formed between the convex arc portion of the lower part of the tongues 43*y*, 43*m*, and 43*c* of the movable levers 41*y*, 41*m*, and 41*c* and the concave arc portion of the tank holder 46 where the tongues 54*y*, 54*m*, and 54*c* are arranged. Further, when observed from the side face, the radius dimensions R1 and R2 do not present the coaxial condition which is indicated in FIG. 11B, and the tank holder 46 and each of the tongues 54*y*, 54*m*, and 54*c* of color ink tanks are disconnected. Therefore, the user can easily recognize that the ink tanks 40*y*, 40*m*, and 40*c* and the tank holder 46 are installed incorrectly. Then, the user can operate again until the ink tanks 40*y*, 40*m*, and 40*c* and the tank holder 46 are in the state as shown in FIGS. 10A and 10B.

Also, as shown in FIG. 12A, if the user should install one of the three ink tank imperfectly on the tank holder 46, the radius dimensions R3 and R4 do not present the coaxial condition only for the ink tank 40*c* when observed from the front side, and an unnatural gap is formed between the convex arc portion of the lower part of the tongues 54*c* of the movable lever 41*c* and the concave arc portion of the tank holder 46 where the tongue 54*c* is arranged. Further, when observed from the side face, the radius dimensions R1 and R2 do not present the coaxial condition which is indicated in FIG. 12B only for the ink tank 40*c* thus installed imperfectly, and the tank holder 46 and the tongue 54*c* of the ink tank 40*c* are disconnected. Therefore, the user can easily recognize that the ink tank 40*c* and the tank holder 46 are installed incorrectly. Then, the user can operate again until the ink tank 40*c* and the tank holder 46 are in the state as shown in FIGS. 10A and 10B.

In accordance with the present embodiment, the radius dimensions of each lower part of the tongues of the movable levers are set as follows:

R2=20 mm, R4=10 mm

The radius dimensions of the holder are:

R1=20 mm, R3=10.3 mm where the R3 is made longer than the R4 by 0.3 mm.

In this way, the user can easily confirm whether or not each of the ink tanks is installed on the tank holder correctly.

(Third Embodiment)

Here, the description will be made of the example in which any one of the ink tanks is prevented from being incorrectly installed by changing the shapes of the convex arc portion of the lower part of each tongue of the movable lever and the concave arc portion of the tank holder where each of the tongues is arranged.

Figure 13:
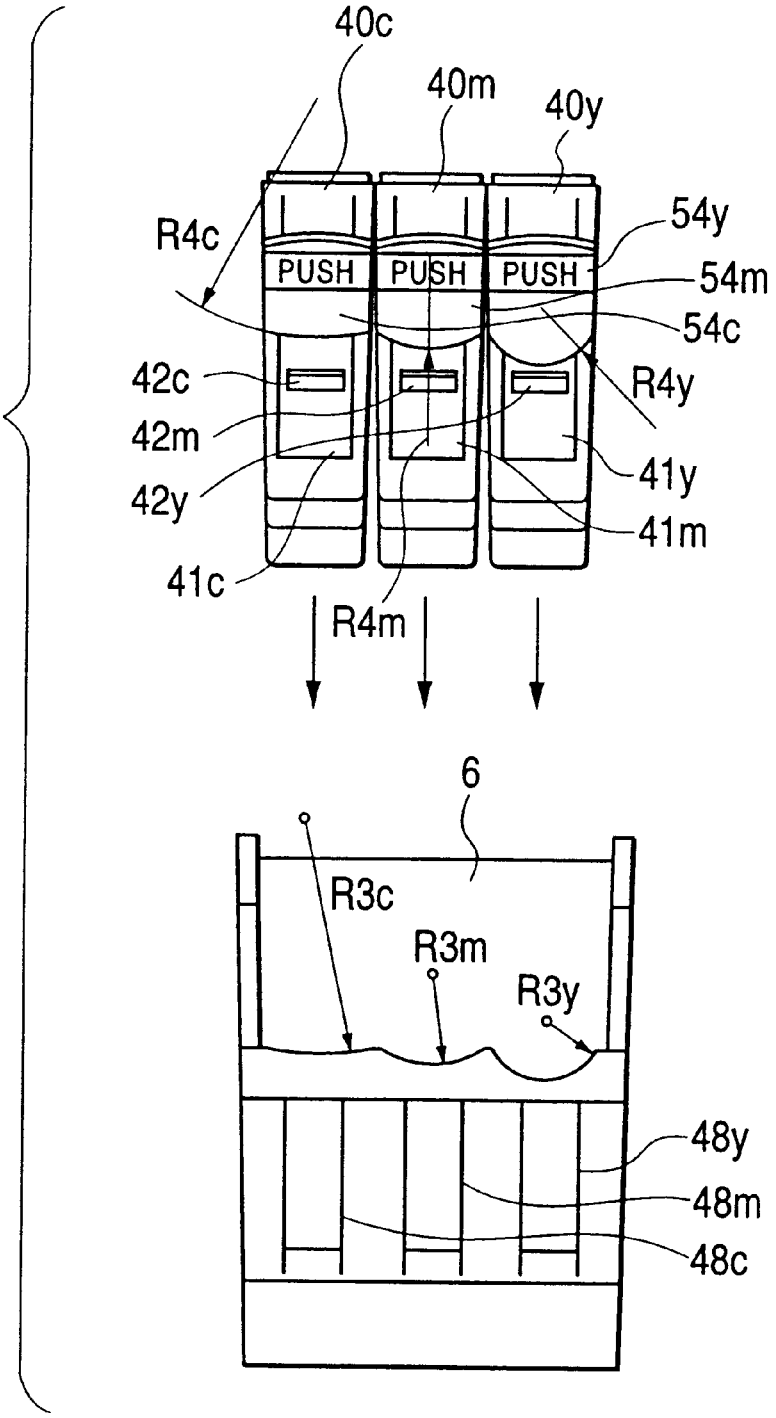
FIG. 13 is a view which illustrates another example of the ink tanks and the tank holder which form the ink jet head cartridge for use of colors to which the present invention is applicable.

FIG. 13 is a front view which shows the ink tanks and the tank holder which constitute the ink jet head cartridge in accordance with a third embodiment of the present invention.

As shown in FIG. 13, each of the lower parts of the tongues 54*y*, 54*m*, and 54*c* of the movable levers 41*y*, 41*m*, and 41*c* on each front face of the color ink tanks 40*y*, 40*m*, and 40*c* is extruded in different shapes, respectively, to present the convex arc, which is regulated by the radius dimension $R4_y$, $R4_m$ and $R4_c$ in the width direction of each ink tank. Also, the location where each of the movable levers 41*y*, 41*m*, and 41*c* are arranged for each of the ink tanks 40*y*,

40*m*, and 40*c* is curved each in different shape on the front face of the tank holder 46 in the form of arc, which is each regulated by the radius dimension R3. ($\cong R4_y$), $R3_m$ ($\cong R4_m$), and $R3_c$. ($\cong R4_c$) in the width direction of the tank holder, respectively.

Further, although not shown, each of the tongues 54*y*, 54*m*, and 54*c* of the movable levers 41*y*, 41*m*, and 41*c* is bent in the direction toward the back face of each ink tank to be in an arc, which is all regulated by the radius dimension $R2_y$, $R2_m$, and $R2_c$ of the same curvature.

For the present embodiment, the radius dimensions of each lower part of the tongues of the movable levers are set as follows:

R2*y*=20 mm, R4*y*=8 mm

R2*m*=20 mm, R4*m*=9 mm

R2*c*=20 mm, R4*c*=10 mm

The radius dimensions of the holder are:

R3*y*=8.4 mm

R3*m*=9.4 mm

R3*c*=10.4 mm where the R3*y*•R3*m*•R3*c* are made longer than the R4*y*•R4*m*•R4*c* by 0.4 mm, respectively.

Figure 14:
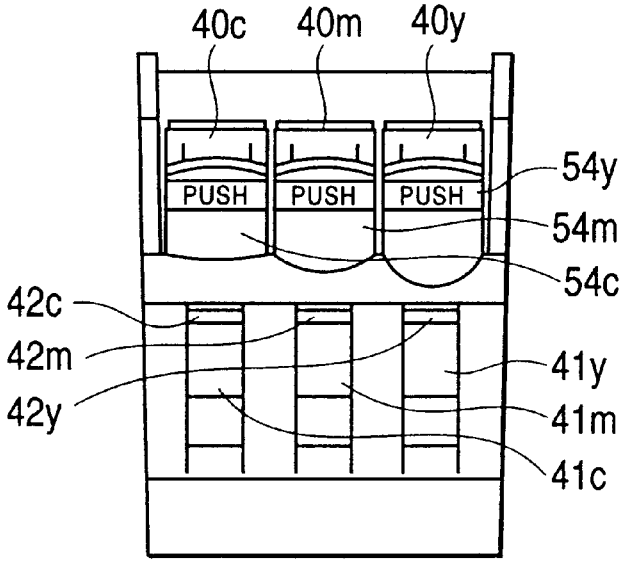
FIG. 14 is a view which illustrates the state where the ink tanks and the tank holder are installed correctly for another example of the ink jet head cartridge for use of colors to which the present invention is applicable.
Figure 15:
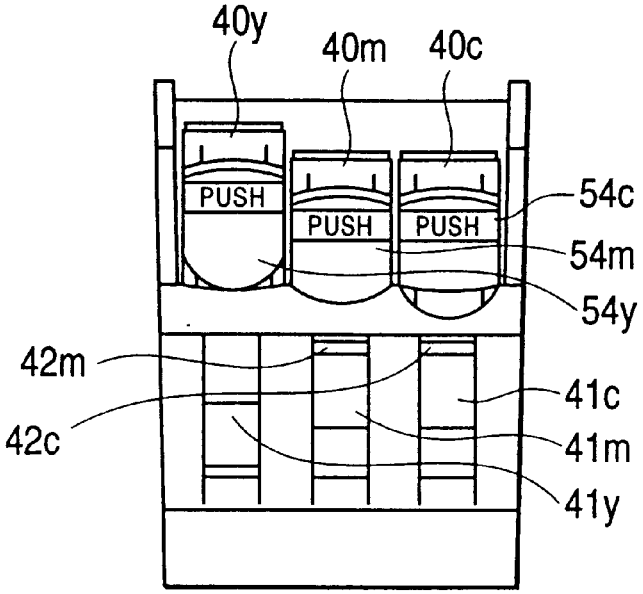
FIG. 15 is a view which illustrates the state where the ink tanks are installed in the wrong position of the tank holder for another example of the ink jet head cartridge for use of colors to which the present invention is applicable.

FIG. 14 is a front view which illustrates the state that each of the color ink tanks shown in FIG. 13 is correctly installed on the tank holder 46. FIG. 15 is a front view which illustrates the state that each of the color ink tanks shown in FIG. 13 is wrongly installed on the tank holder.

As shown in FIG. 14, if the user installs the ink tanks 40*y*, 40*m*, and 40*c* on the tank holder 46 correctly, the arcs of the radius dimensions of the R3*y*•R3*m*•R3*c* and the R4*y*•R4*m*•R4*c* become coaxial when observed from the front side. Then, only a specific gap (dimensional tolerance) is formed between the convex arc portion on each lower part of the tongues 54*y*, 54*m*, and 54*c* of the movable members 41*y*, 41*m*, and 41*c*, and each of the concave arc portions of the tank holder 46, and both of the arc portions are in agreement with each other.

Further, although not shown, when observed from the side face, the tank holder 46 and the tongues 54*y*, 54*m*, and 54*c* of the color ink tanks are connected smoothly in the form of arc, respectively.

In other words, the user can recognize that the outer appearances of the tank holder 46 and each of the color ink tanks 40*y*, 40*m*, and 40*c* are smoothly connected in the form of coaxial arcs when observing them from the front side or from the side face.

If, on the contrary, the user should install incorrectly all the ink tanks 40*y*, 40*m*, and 40*c* in the wrong positions of the tank holder 46, such as the yellow ink tank 40*y* in the position of the cyan ink tank 40*c* on the tank holder 46, and the cyan ink tank 40*c* is installed in the position of the yellow ink tank 40*y* on the tank holder 46 as shown in FIG. 15, for example, the radius dimensions R3*y* and R4*c* do not present the coaxial condition when observed from the front side. The radius dimensions R3*c* and R4*y* do not present the coaxial condition, either. As a result, an unnatural gap is formed between each convex arc portion of the lower part of the tongues 54*y* and 54*c* of the movable members 41*y* and 41*c* and the concave arc portion of the tank holder 46 where each of the tongues 54*y* and 54*c* is arranged. Thus, it becomes possible to recognize that the ink tanks 40*y* and 40*c* are not installed in the exact positions of the tank holder 46. Further, when observed from the side face, the tank holder 46 and the tongues 54*y* and 54*c* of the respective color ink tanks are disconnected. Therefore, the user can easily recognize that the ink tanks 40*y* and 40*c* and the tank holder 46 are installed incorrectly. Then, the user can operate again for replacement until the ink tanks 40*y* and 40*c* are in the state as shown in FIG. 14.

In this way, the user can recognize that the ink tanks are correctly installed on the tank holder. Here, if the installation should be imperfect, the tank 40*y* nor the tank 40*c* is not in the state where ink can be supplied. There is no particular problem as to the mixture of ink in its essential meaning.

As described above, the present invention relates to the ink tanks detachably held on the tank holder having arc portions each with a specific curvature, respectively, as well as the tank holder that detachably holds the ink tanks having arc portions each with a specific curvature. Then, the arrangement is made so that only when each of the ink tanks is installed in the correct position of the tank holder perfectly, each arc center of the arc portions of the ink tanks is in agreement with each arc center of the arc portions of the tank holder, respectively. In this way, it becomes possible to enable the user to confirm whether or not the ink tanks are correctly installed on the tank holder with a simple and inexpensive method.

Further, each of the arc positions of the ink tanks is made each of the tongues of the movable levers used for the removal or the installation of the ink tanks. Thus, the handling of each tongue is facilitated more so as to enable the user to execute the attachment or detachment of each ink tank with ease accordingly.

Further, each tongue of the ink tanks is in the specific form of arc to make it possible to disperse the acting force required for removing the ink tank to the acting force needed to push forward the movable lever and the one needed to push up the ink tank in good balance. As a result, each of the ink tanks can be removed with a slight acting force. In this manner, each of the ink tanks can be removed by use of a slight acting force, and any compulsory force is not needed additionally to remove each of them. Hence, there is no possibility that the positioning pin arranged on the bottom face of the ink tank and the positioning hole arranged on the tank hole are caused to rub each other unnaturally. Then, the positioning pin or the positioning hole is prevented from being cut off, thus minimizing the drawback that may impede the execution of perfect positioning.

Now, the description will be made of the ink tank by exemplifying the black ink tank 30 that contains ink of black color.

Figure 16:
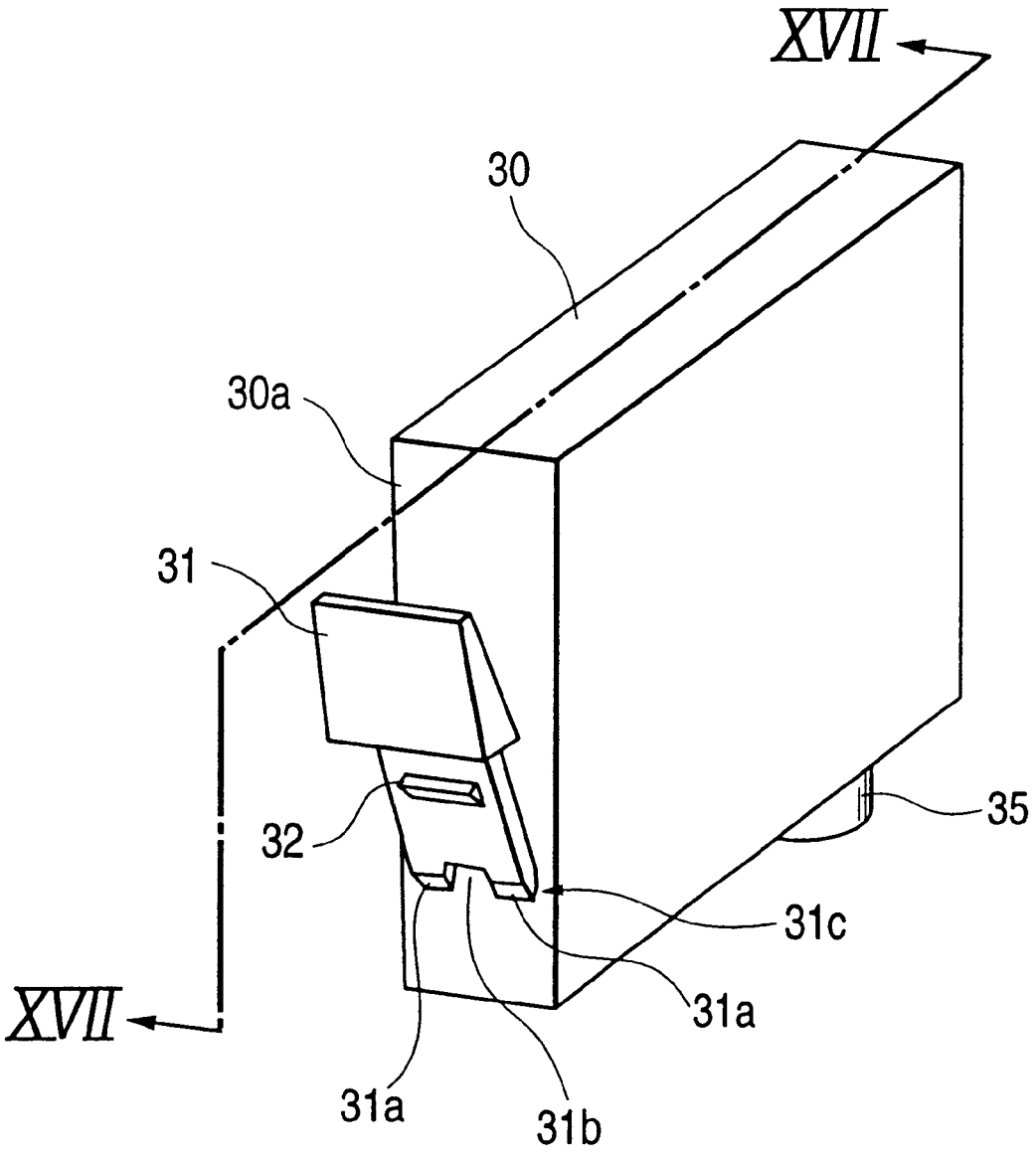
FIG. 16 is a perspective view which shows another ink tank to which the present invention is applicable.
Figure 17A:
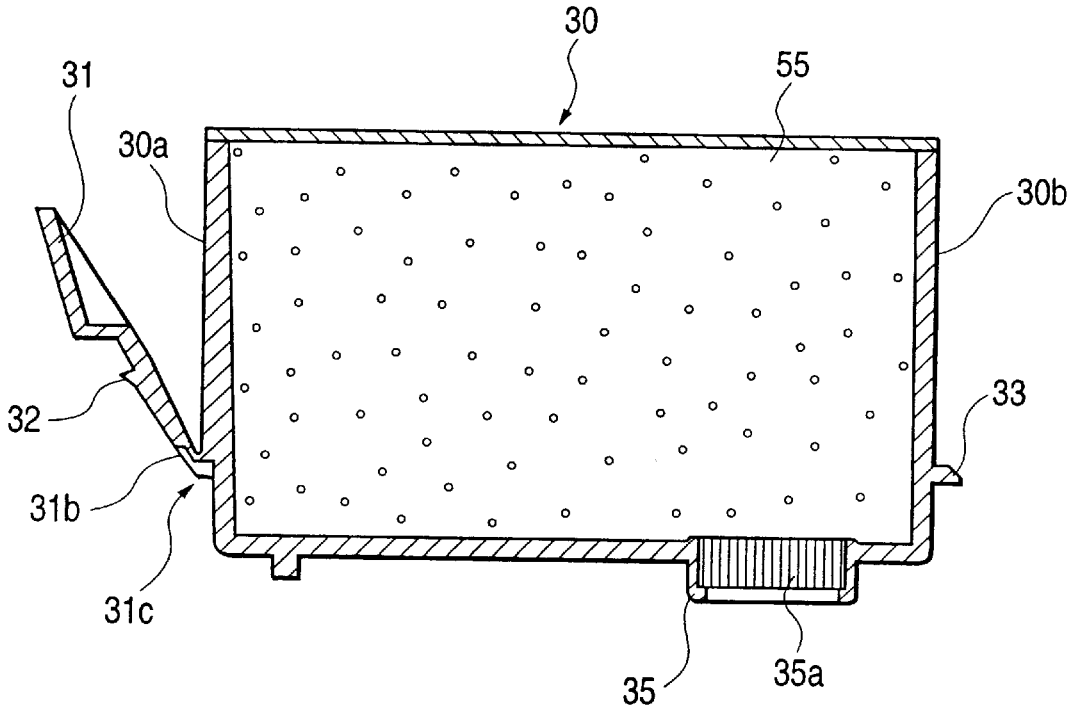
FIG. 17A is a cross-sectional view which shows the ink tank represented in FIG. 16, taken along line XVII to XVII.
Figure 17B:
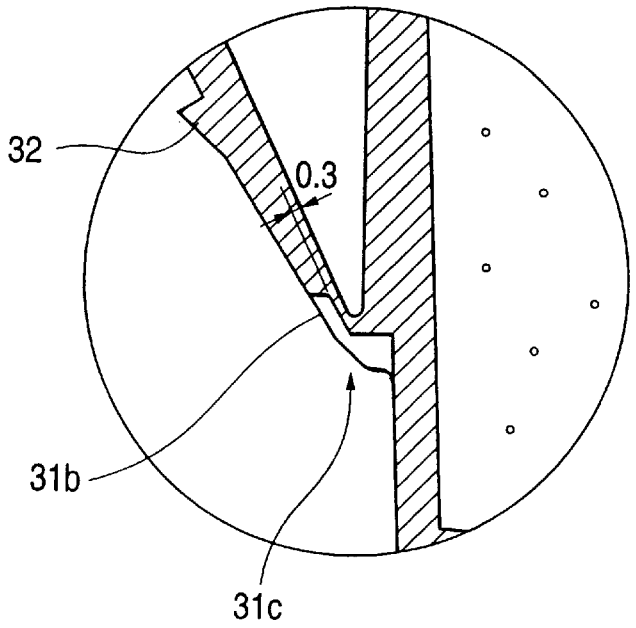
FIG. 17B is an enlargement of the detailed view which illustrates the foot section of the movable lever thereof.

FIG. 16 is a perspective view which shows a black ink tank 30 in accordance with a fourth embodiment of the present invention. FIG. 17A is a cross-sectional view of the black ink tank 30 represented in FIG. 16, taken along line XVII—XVII. FIG. 17B is an enlargement of the detailed view of the foot section 31*c* of the movable member shown in the cross-sectional view in FIG. 17A.

On the first side face 30*a* of the black ink tank 30, the movable lever 31 with the first nail 32 which is formed to serve as a first engagement portion is arranged to be resiliently displaceable with the foot portion 31*c* of the movable lever as its fulcrum. The foot portion 31*c* of the movable member comprises the wall thickness portions 31*a* on both ends thereof; and the thinner thickness portion 31*b* having its center formed thinner than the wall thickness portions 31*a*.

In the black ink tank 30, the ink absorbent 55 is housed to retain ink as shown in FIG. 17A. Then, ink is supplied to the outside from the ink supply port 35 through the joint member 35*a*. Also, on the second side face 30*b*, the second nail 33 is formed to serve as the second engagement portion.

The movable member 31 is molded integrally with the tank main body. For the molding material thereof, polypropylene is adopted, because while it is inexpensive, it provides good resistance to ink, gas barrier properties, and excellent transparency.

Now, the description will be made of the effects of the thinner thickness portion 31*b* formed at the foot section 31*c* of the movable member in accordance with the present embodiment.

Figure 18:
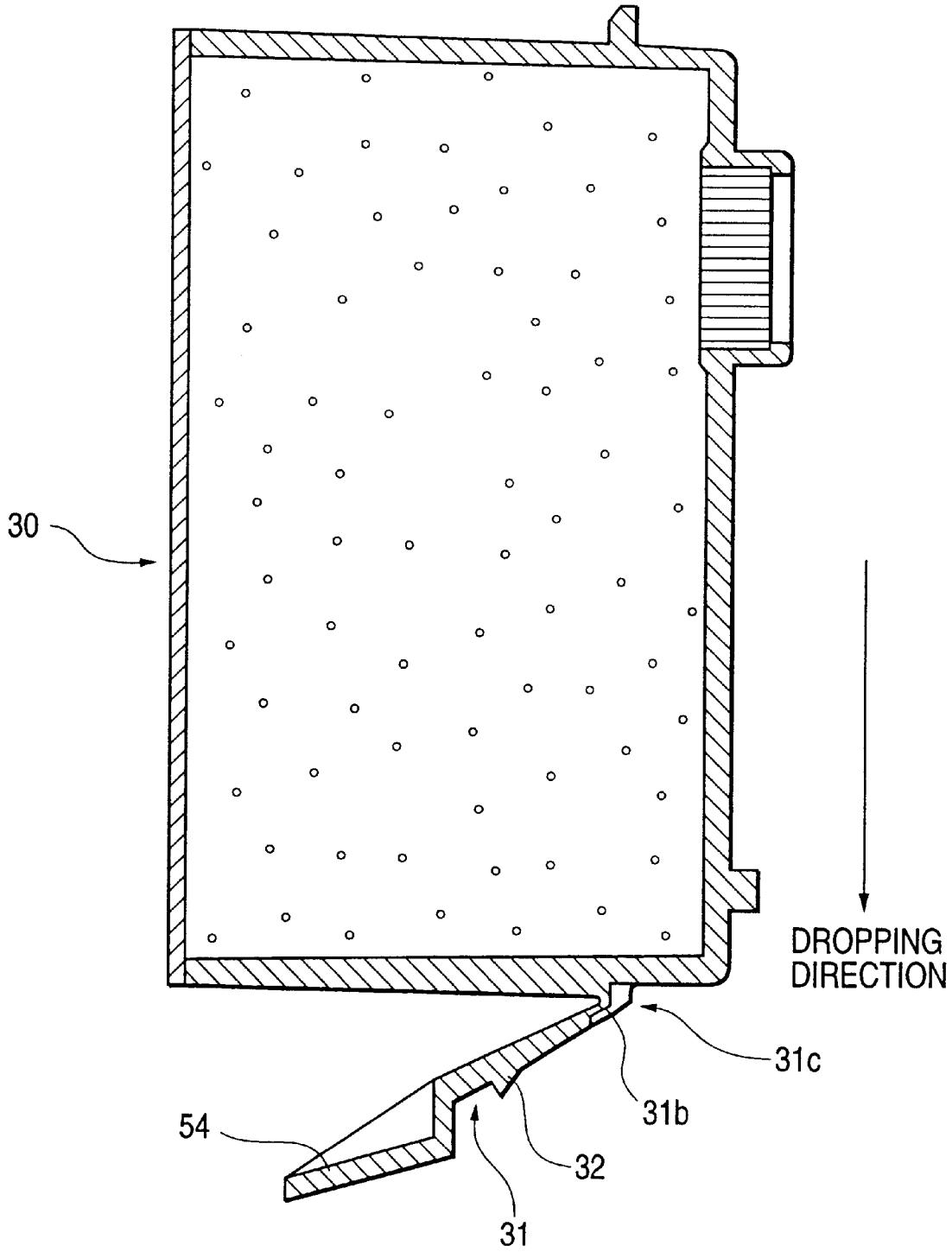
FIG. 18 is a view which shows the state where the ink tank is dropped with the movable lever downward.
Figure 19:
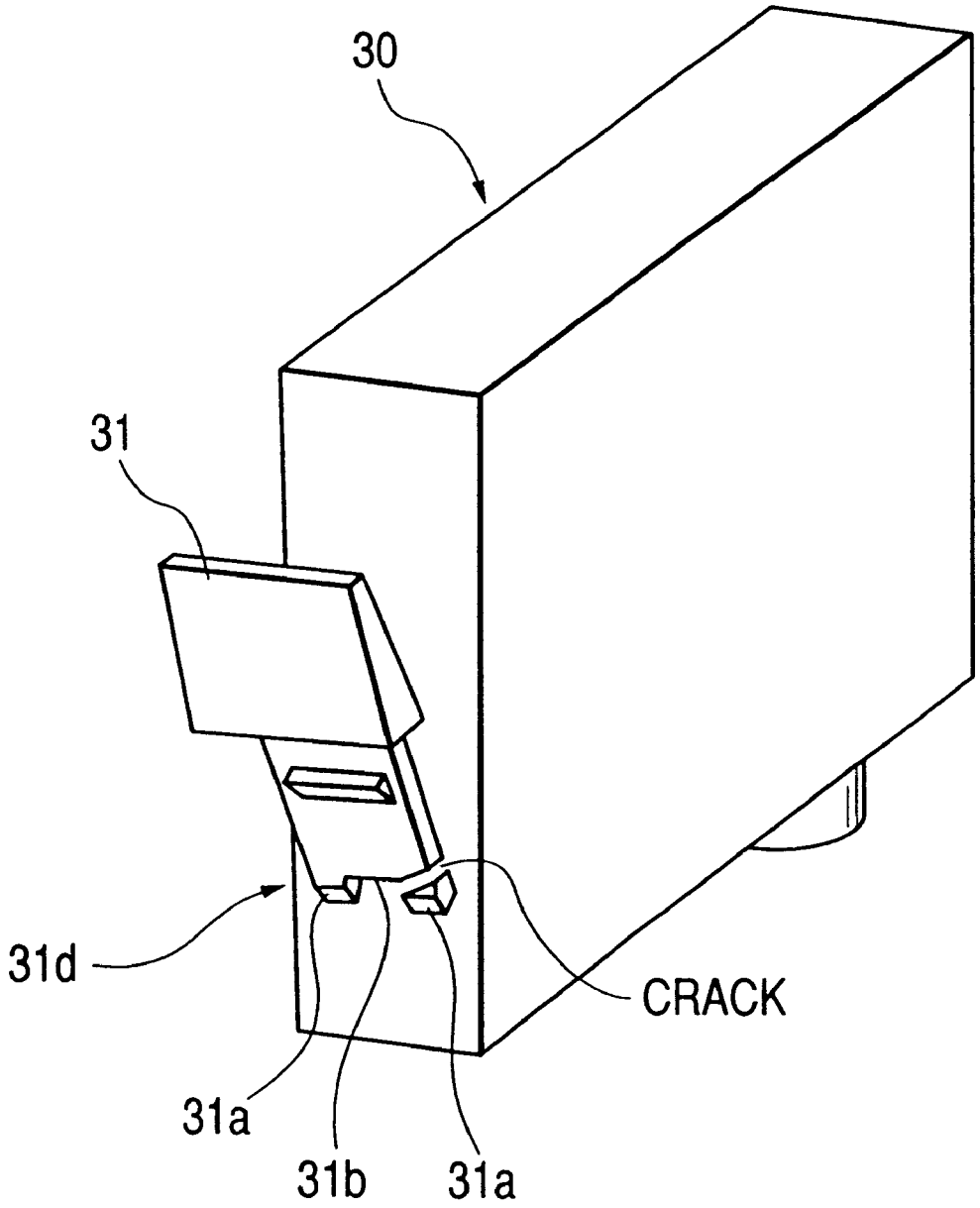
FIG. 19 is a view which shows the state where a crack is caused on the wall thickness of the movable lever by the shock when it is dropped.

As shown in FIG. 18, if the user should drop the black ink tank 30 accidentally with the movable lever 31 downward so that the foot section 31*c* of the movable member receives a shock, the thinner thickness portion 31*b* blocks the development of crack when the crack thus caused by shock takes place on the wall thickness portion 31*a* on one side as shown in FIG. 19, and the development thereof does not reach the wall thickness portion 31*a* on the other side. Also, if the shock is given to the opposite side to cause the crack to develop from the wall thickness portion 31*a* on that side, this crack development is blocked by the thinner thickness portion 31*b*, and it does not reach the wall thickness portion 31*a* on the other side. Thus, the movable lever 31 is not broken completely to be separated from the tank main body 30 to make it possible to maintain the installation mechanism of the black ink tank 30 with respect to the tank holder 36.

Here, it is desirable to arrange the thickness of the thinner portion 31*b* to be a half of or less than the half the thickness of the wall thickness portion 31*a*. This is because it has been confirmed by experiments that the development of the crack caused by the shock destruction is not blocked by the thinner thickness portion 31*b* if the thickness of this portion 31*b* is made more than a half the thickness of the wall thickness portion 31*a*. For the present embodiment, the thickness of the wall thickness portion 31*a* is 0.8 mm, and that of the thinner portion 31*b* is 0.3 mm.

In this way, even if the user should incidentally drop the black ink tank 30 with the movable lever 31 side downward, it is possible to protect the black ink tank 30 from being disabled to be installed on the tank holder by the breakage that may take place only on the foot section 31*c* of the movable member which serves as the fulcrum of the movable member 31.

(Fifth Embodiment)

FIG. 20 is a perspective view which shows the black ink tank 30 in accordance with a fifth embodiment of the present invention. Also, FIG. 21A is a cross-sectional view which shows the black ink tank 30 represented ted in FIG. 20, taken along line XXI—XXI. FIG. 21B is an enlargement of the detailed view which illustrates the foot section 31*c* of the movable member shown in the cross-sectional view shown in FIG. 21A.

Whereas the thinner thickness portion 31*b* is formed on the inner face side (upper face side) of the lever foot section 31*c* in accordance with the fourth embodiment, the thinner thickness portion 31*b* is formed on the outer face side (lower face side) of the lever foot section 31*c* for the present embodiment.

With the formation of the thinner thickness portion 31*b* on the outer face side (lower face side) of the lever foot section 31*c*, the movable lever 31 is only destructed at the lever foot section 31*c* even if the shock destructive force is exerted on the upper end of the movable lever 31 in the direction indicated by an arrow F in FIG. 21A.

As in the fourth embodiment, it is desirable to make the thickness of the thinner portion 31*b* a half of or less than the half the thickness of the wall thickness portion 31*a*. For the present embodiment, the thickness of the wall thickness portion 31*a* is 0.8 mm and the thinner thickness portion 31*b* is 0.3 mm.

In this way, even if the user should incidentally drop the black ink tank 30 with the movable lever 31 side downward, it is possible to protect the black ink tank 30 from being disabled to be installed on the tank holder 36 by the breakage that may take place only on the foot section 31*c* of the movable member which serves as the fulcrum of the movable member 31.

(Sixth Embodiment)

FIG. 22 is a perspective view which shows the ink tank 30 in accordance with a sixth embodiment of the present invention.

The ink tank 30 is widely structured in the width direction in a larger capacity than the black ink tank of the fourth and fifth embodiments described above. Each of the wall thickness portions is formed on three parts, respectively, that is, both ends of the foot section 31*c* of the movable lever of the movable lever 31 having the first nail 32 formed therefor, and the central portion thereof. Between each of the wall thickness portions 31*a*, the thinner thickness portions are formed on two locations.

FIG. 23A is an enlargement of the detailed view of the wall thickness portion 31*a*. FIG. 23B is an enlargement of the detailed view of the thinner thickness portion 31*b*.

In the case of the ink tank 30 which is structured wider in the width direction, its weight becomes greater when ink is filled fully in the ink tank 30. The impact force given to the foot section 31*c* of the movable member becomes greater accordingly if the user should incidentally drop the ink tank.

Here, the multiple structure, such as to arrange the wall thickness portion and the thinner thickness portion alternately for the wall thickness portion 31*a* and thinner thickness portion 31*b* of the foot section 31*c* of the movable member, is provided against an impact force of the kind so that the foot section 31*c* of the movable member can be protected from the greater shock destruction.

Here, too, it is desirable to make the thickness of the thinner portion 31*b* a half of or less than the half the thickness of the wall thickness portion 31*a*. For the present invention, the thickness of the wall thickness portion 31*a* is 0.8 mm, and that of the thinner thickness portion 31*b* is 0.3 mm.

In accordance with the present embodiment, the thinner thickness portion 31*b* is arranged on the upper face side of the lever as in the fourth embodiment, but it may be arranged on the outer face side of the lever as in the fifth embodiment.

Also, in accordance with the present embodiment, the wall thickness portion 31*a* and the thinner thickness portion 31*b* are arranged in the five-stage structure, but it may be possible to structure them in the plural stages other than the one exemplified here.

As described above, the foot section of the movable lever is structured with the thinner thickness portions and the wall thickness portions which are arranged alternately in accordance with the present invention. Therefore, even when a destructive impact force is given to the movable member, and the crack destruction takes place on the wall thickness portion, the crack development is blocked by the presence of the thinner thickness portion. The crack development does not reach any other wall thickness portions. Therefore, even if the user should incidentally use the ink tank so that the destructive impact force is given to the movable lever, only the foot section of the movable lever is broken so as to protect the ink tank from being disabled to be installed on the tank holder.

(Seventh Embodiment)

FIG. 24A is a front view which shows the ink tank and the tank holder which constitute the ink jet head cartridge for use of black ink in accordance with a seventh embodiment of the present invention. FIG. 24B is a side view of the ink tank and the tank holder.

As shown in FIG. 24A, the lower part of the tongue 54 of the movable lever 31 on the front face of the ink tank 30 is extruded to present the convex arc regulated by the radius dimension R4 in the width direction of the ink tank 30. Also, the location where the movable lever 31 is arranged for the ink tank 30 is curved on the front face of the tank holder 36, which is in the form of arc regulated by the radius dimension R3 (≅R4) in the width direction of the tank holder 36.

Further, as shown in FIG. 24B, the tongue 54 of the movable lever 31 is bent in the direction toward the back face of the ink tank to be in an arc regulated by the radius dimension R2 in the back face direction of the ink tank 30. Also, the location where the movable lever 31 is arranged for the ink tank 30 is curved in the back face direction of the tank holder 36, which is in the form of arc regulated by the radius dimension R1 (≅R2) in the back face direction of the tank holder 36.

In this manner, the tongue 54 of the ink tank 30 is in the form of arc regulated by the R2 to make it possible to disperse the acting force exerted at the time of ink tank removal both to the acting forces of the forward pushing operation of the movable member 31 and pushing up operation of the ink tank in good balance. As a result, the ink tank can be removed with a slight acting force.

Here, since the ink tank can be removed with a light acting force, no excessive force is then exerted on the ink tank to be removed. Thus, there is no possibility that the positioning pin arranged on the bottom face of the ink tank and the positioning hole arranged for the tank holder are allowed to rub each other unnaturally. The positioning pin or the positioning hole is prevented from being cut off so as to minimize the drawback that may be brought to the execution of perfect positioning.

Also, as shown in FIG. 24A, the movable member 31 is arranged to be resiliently displaceable with the its foot section 31*c* as the fulcrum. The foot section 31*c* of the movable member is structured with the wall thickness portions 31*a* on both ends thereof, and the thinner thickness portion 31*b* on the central part thereof, which is thinner than the wall thickness portions 31*a*.

With the formation of the thinner portion 31*b* for the foot section 31*c* of the movable member, the movable member 31 is not broken completely, because even if the user should incidentally drop the ink tank with the movable member 31 downward to give shock to the foot section 31*c*, and the destructive impact is given to the wall thickness portion 31*a* on one side, it does not reach the wall thickness portion 31*a* on the other side due to the presence of the thinner thickness portion 31*b* between them. Then, the movable member is not separated from the tank main body 30, thus maintaining the installation mechanism of the ink tank 30 to the tank holder 36.

Here, it should be good enough if only the thickness of the thinner portion 31*b* satisfies the same condition as the previous embodiment, and it is desirable to make the thickness of this portion a half of or the less than the half the thickness of the wall thickness portion 31*a*. For the present embodiment, the thickness of the wall thickness portion 31*a* is 0.8 mm and that of the thinner portion 31*b* is 0.3 mm.

As described above, with the provision of the alternative arrangement of the wall thickness portions and the thinner thickness portion together with the arc formation of the tongue portion for the structural arrangement of the movable member, it becomes possible to prevent the movable member from being broken, and it becomes also easier to confirm the condition of the installation by eye-sight. Therefore, the ink tank is reliably installed on the tank holder securely, and at the same time, it is made easier for the user to deal with the installation of the ink tank.

What is claimed is:

1. An ink tank detachably held by a tank holder which includes an engagement portion and an arc shape portion of a specific curvature, said ink tank comprising:

a housing for ink; and a movable lever provided with an engagement nail to engage with the engagement portion of the tank holder, said movable lever being provided with a tongue portion above said engagement nail such that said tongue portion is operable when said ink tank is detached from said tank holder;

wherein said tongue portion has an arc shape portion of a specific curvature, and the arc center of the arc shape portion of said tongue portion is at a position outside a space occupied by said tongue portion and said ink tank outside an outer side surface of said tongue portion, and further is in the same position as the arc center of the arc shape portion of said tank holder only when said ink tank is correctly held on said tank holder.

2. An ink tank according to claim 1, wherein said movable lever is resiliently connected with said housing of said ink tank, and a part of said resilient connection is formed thinner in the thickness thereof.

3. An ink tank according to claim 1, wherein the arc shape portion of said ink tank is different in accordance with ink capacity of said ink tank.

4. An ink tank according to claim 1, wherein the arc shape portion of said ink tank is different in accordance with a type of ink in said ink tank.

5. An ink tank according to claim 1, wherein said movable lever is molded integrally with said housing of said ink tank.

6. An ink tank according to claim 1, wherein the radii of curvature of the arc shape portions of said ink tank and said tank holder are the same.

7. An ink tank according to claim 1, wherein the arc shape of said tongue portion is an arc shape with respect to a width direction, having a center upward of the lever portion.

8. An ink tank according to claim 1, wherein the arc shape of said tongue portion is an arc shape with respect to a vertical direction, having a center outwardly which faces the ink tank with the lever being sandwiched therebetween.

9. A tank holder for detachably holding an ink tank which includes a housing and a movable lever provided with an engagement nail and a tongue portion above the engagement nail such that the tongue portion is operable when the ink tank is detached from said tank holder, wherein said tongue portion has an arc shape portion of a specific curvature, said tank holder comprising:

an engagement portion for engagement with the engagement nail of the ink tank; and an arc shape portion of a specific curvature, and the arc center of the arc shape portion of said tank holder is at a position outside a space occupied by said tank holder outside an outer side surface of said tank holder, and further is in the same position as the arc center of the arc shape portion of said tongue portion of said ink tank only when said ink tank is correctly held on said tank holder.

10. A tank holder according to claim 9, wherein the arc shape portion of said ink tank is different in accordance with ink capacity of said ink tank.

11. A tank holder according to claim 9, wherein the arc shape portion of said ink tank is different in accordance with a type of ink in said ink tank.

12. A tank holder according to claim 9, wherein the radii of curvature of the arc shape portions of said ink tank and said tank holder are the same.

13. A tank holder according to claim 9, wherein the arc shape of said tongue portion is an arc shape with respect to a width direction, having a center upward of the lever portion.

14. An tank holder according to claim 9, wherein the arc shape of said tongue portion is an arc shape with respect to a vertical direction, having a center outwardly which faces the ink tank with the lever being sandwiched therebetween.

15. An ink head cartridge comprising:

a tank holder according to any one of claims 9, 10, 11, 12, 13 or 14; and an ink jet recording head for discharging ink to be supplied from the ink tank installed on said tank holder.

16. An ink jet recording apparatus comprising:

a carriage detachably holding an ink jet head cartridge according to claim 15, and being supported for reciprocation along the surface of a recording medium, and ink being discharged from the ink jet recording head portion of said ink jet head cartridge for recording on said recording medium in accordance with electric signals for ink discharge.

17. An ink tank detachably held by a tank holder, said ink tank having a movable lever provided with an engagement nail to engage with said tank holder, said movable lever being resiliently supported on a foot section of said movable member, wherein in a thickness direction said foot section is thin relative to a whole of said movable member, and wherein in a width direction said foot section includes alternating thin and thick portions.

18. An ink tank according to claim 17, wherein said movable lever is integrally formed with said ink tank by molding.

19. An ink tank according to claim 17, wherein said movable lever is provided with a tongue portion used for attaching said ink tank to said tank holder or detaching said ink tank therefrom, and a part of said tongue portion is in the form of an arc.

20. An ink tank according to claim 19, wherein said tank holder has an arc shape portion positioned at the location of said tongue portion when said ink tank is held by said tank holder, and with said ink tank being held correctly, the arc center of the arc shape portion of the tank holder and that of the ink tank become identical.

21. An ink tank according to claim 17, wherein a thickness of said foot section is one half of or less than a thickness of other parts of the foot section.

22. An ink jet head cartridge comprising:

a tank holder for detachably holding an ink tank according to any one of claims 17, 18, 19, 20 or 21; and a liquid discharge head unit for discharging ink to be supplied from the ink tank.

23. An ink jet recording apparatus comprising:

a carriage detachably holding an ink jet head cartridge according to claim 22, being supported for reciprocation along the surface of a recording medium, and ink being discharged from said liquid discharge recording head unit of said ink jet head cartridge for recording on said recording medium in accordance with electric signals for ink discharge.

24. An ink tank detachably held on a tank holder having an arc shape portion of a specific curvature, said ink tank comprising:

a movable lever provided with an engagement nail to engage with said tank holder, said movable lever being resiliently supported by said ink tank at a foot section thereof;

wherein said movable lever is provided with a tongue portion above said engagement nail, said tongue portion being operable when attaching said ink tank to or detaching said ink tank from said tank holder;

wherein said tongue portion is provided with an arc shape portion of a specific curvature;

wherein the arc center of the arc shape portion of said ink tank is in the same position as the arc center of the arc shape portion of said tank holder only when said ink tank is correctly held on said tank holder; and wherein a part of the foot section of said movable lever is formed thinner in the thickness thereof.

25. An ink tank according to claim 24, wherein the arc portion of said ink tank is different in accordance with ink capacity of said ink tank.

26. An ink tank according to claim 24, wherein the arc portion of said ink tank is different in accordance with a type of ink in said ink tank.

27. An ink tank according to claim 26, wherein a thickness of said part of said foot section is one half of or less than a thickness of other parts of the foot section.

* * * * *

UNITED STATES PATENT AND TRADEMARK OFFICE

CERTIFICATE OF CORRECTION

PATENT NO. : 6,350,025 B1
DATED : February 26, 2002
INVENTOR(S) : Osamu Morita et al.

It is certified that error appears in the above-identified patent and that said Letters Patent is hereby corrected as shown below:

Column 2,
Line 54, "Joint" should read -- joint --.

Column 3,
Line 38, "to as" should read -- so as --; and
Line 42, "use" should read -- use of --.

Column 6,
Line 1, "discuss" should read -- discussed --;
Line 17, "for,m" should read -- form --; and
Line 47, "an" should read -- and --.

Column 7,
Line 63, "ink," should read -- inks, -- and "performs" should read -- perform --; and
Line 64, "performs" should read -- perform --.

Column 9,
Line 11, "structure" should read -- structured --.

Column 12,
Line 23, "ink tank" should read -- ink tanks --.

Column 13,
Line 3, "R3." should read -- $R3_y$ --; and
Line 4, "$R3_c$." should read -- $R3_c$ --.

Column 19,
Line 11, "An" should read -- A --.

Signed and Sealed this

Twenty-first Day of May, 2002

*Attest:*

*Attesting Officer*

JAMES E. ROGAN
*Director of the United States Patent and Trademark Office*